US006401486B1

(12) United States Patent
Lee et al.

(10) Patent No.: US 6,401,486 B1
(45) Date of Patent: Jun. 11, 2002

(54) ENHANCED NGL RECOVERY UTILIZING REFRIGERATION AND REFLUX FROM LNG PLANTS

(76) Inventors: Rong-Jwyn Lee, 1906 Valleria Ct., Sugar Land, TX (US) 77479; Jame Yao, 1151 Gloria Ct.; Jong Juh Chen, 5631 Whisper Ridge, both of Sugar Land, TX (US) 77478; Douglas G. Elliot, 506 Fairport, Houston, TX (US) 77079

( * ) Notice: Subject to any disclaimer, the term of this patent is extended or adjusted under 35 U.S.C. 154(b) by 0 days.

(21) Appl. No.: 09/733,533

(22) Filed: Dec. 8, 2000

Related U.S. Application Data

(60) Provisional application No. 60/205,332, filed on May 19, 2000.

(51) Int. Cl.[7] ..... F25J 3/00
(52) U.S. Cl. ..... 62/630; 62/623
(58) Field of Search ..... 62/611, 612, 613, 62/614, 619, 620, 630, 623

(56) References Cited

U.S. PATENT DOCUMENTS

| | | | | |
|---|---|---|---|---|
| 3,724,226 A | * | 4/1973 | Pachaly | 62/612 |
| 4,033,735 A | | 7/1977 | Swenson | 62/9 |
| 4,065,278 A | * | 12/1977 | Newton et al. | 62/613 |
| 4,140,504 A | | 2/1979 | Campbell et al. | 62/28 |
| 4,251,249 A | | 2/1981 | Gulsby | 62/28 |
| 4,278,457 A | | 7/1981 | Campbell et al. | 62/24 |
| 4,404,008 A | | 9/1983 | Rentler et al. | 62/11 |
| 4,430,103 A | * | 2/1984 | Gray et al. | 62/630 |
| 4,445,916 A | | 5/1984 | Newton | 62/17 |
| 4,445,917 A | | 5/1984 | Chiu | 62/25 |
| 4,657,571 A | | 4/1987 | Gazzi | 62/17 |
| 4,687,499 A | | 8/1987 | Aghili | 62/24 |

(List continued on next page.)

FOREIGN PATENT DOCUMENTS

| | | | |
|---|---|---|---|
| WO | WO 95/27179 | 10/1995 | F25J/1/02 |

OTHER PUBLICATIONS

"LPG–Recovery Processes for Baseload LNG Plants Examined," Chen–Hwa Chiu, published in *Oil & Gas Journal*, Nov. 24, 1997.

"Flexibility, Efficiency to Characterize Gas–Processing Technologies,", R.J. Lee, J. Yao, D.G. Elliot, IPSI LLC, published in *Oil & Gas Journal*, Dec. 13, 1999.

(List continued on next page.)

*Primary Examiner*—William C. Doerrler
(74) *Attorney, Agent, or Firm*—Shook, Hardy & Bacon L.L.P.; William P. Jensen, Esq.; Walter R. Brookhart, Esq.

(57) ABSTRACT

The present invention is directed to methods and apparatus for improving the recovery of the relatively less volatile components from a methane-rich gas feed under pressure to produce an NGL product while, at the same time, separately recovering the relatively more volatile components which are liquified to produce an LNG product. The methods of the present invention improve separation and efficiency within the NGL recovery column while maintaining column pressure to achieve efficient and economical utilization of the available mechanical refrigeration. The methods of the present invention are particularly useful for removing cyclohexane, benzene and other hazardous, heavy hydrocarbons from a gas feed. The benefits of the present invention are achieved by the introduction to the NGL recovery column of an enhanced liquid reflux lean on the NGL components. Further advantages can be achieved by thermally linking a side reboiler for the NGL recovery column with the overhead condenser for the NGL purifying column. Using the methods of the present invention, recoveries of propane and heavier components in excess of 95% are readily achievable.

47 Claims, 7 Drawing Sheets

U.S. PATENT DOCUMENTS

| | | | | | |
|---|---|---|---|---|---|
| 4,690,702 | A | * | 9/1987 | Paradowski et al. | 62/630 |
| 4,851,020 | A | | 7/1989 | Montgomery, IV | 62/24 |
| 4,970,867 | A | | 11/1990 | Herron et al. | 62/11 |
| 5,291,736 | A | * | 3/1994 | Paradowski | 62/620 |
| 5,325,673 | A | | 7/1994 | Durr et al. | 62/23 |
| 5,537,827 | A | | 7/1996 | Low et al. | 62/613 |
| 5,568,737 | A | | 10/1996 | Campbell et al. | 62/621 |
| 5,615,561 | A | * | 4/1997 | Houshmand et al. | 62/611 |
| 5,669,234 | A | | 9/1997 | Houser et al. | 62/612 |
| 5,737,940 | A | | 4/1998 | Yao et al. | 62/620 |
| 5,755,114 | A | | 5/1998 | Foglietta | 62/618 |
| 5,771,712 | A | | 6/1998 | Campbell et al. | 62/621 |
| 5,799,507 | A | * | 9/1998 | Wilkinson et al. | 62/621 |
| 5,950,453 | A | * | 9/1999 | Bowen et al. | 62/612 |
| 5,992,175 | A | | 11/1999 | Yao et al. | 62/621 |
| 6,016,665 | A | | 1/2000 | Cole et al. | 62/612 |
| 6,023,942 | A | * | 2/2000 | Thomas et al. | 62/613 |
| 6,116,050 | A | * | 9/2000 | Yao et al. | 62/630 |

OTHER PUBLICATIONS

"Next Generation Processes for NGL/LPG Recovery," Richard N. Pitman, Hank M. Hudson and John D. Wilkinson—Ortloff Engineers, Ltd.; Kyle T. Cuellar—Vastar Resources—published proceedings of the 77$^{th}$ GPA Annual Convention, Mar. 16–18, 1998.

"LPG–Recovery in Baseload LNG Plant," Chen–Hwa Chiu—Bechtel Corporation, presented at GASTECH 96 and at the Spring National AlChE meeting, Mar. 9–13, 1997.

* cited by examiner

ENHANCED NGL RECOVERY UTILIZING REFRIGERATION AND REFLUX FROM LNG PLANTS

This Appln claims benefit of Prov. No. 60/205,332 filed May 18, 2000.

BACKGROUND OF THE INVENTION

I. Field of the Invention

The present invention relates generally to methods and apparatus for high recovery of hydrocarbon liquids from methane-rich natural gases and other gases, e.g., refinery gases. More particularly, the present invention provides methods and apparatus for more efficiently and economically achieving high recovery of ethane, propane, propylene and heavier hydrocarbon liquids ($C_{2+}$ hydrocarbons) in association with liquified natural gas production.

II. Description of the Background

Due to its clean burning characteristics and the implementation of more stringent environmental regulations, the projected demand for natural gas has been increasing during recent years. In addition to methane, natural gas includes some heavier hydrocarbons and impurities, e.g., carbon dioxide, nitrogen, helium, water and non-hydrocarbon acid gases. After compression and separation of these impurities, natural gas may be further processed to separate and recover heavier hydrocarbons as natural gas liquids (NGL) and produce pipeline quality methane. The pipeline quality methane is then delivered to gas pipelines as the sales gas ultimately transmitted to end-users.

In the case of remote gas production or distant gas markets, transportation of produced natural gas via gas pipeline might not be economical or even feasible. Accordingly, liquifaction of natural gas has become a viable and widely adopted scheme. The economics of liquifying natural gas is feasible due mainly to the great reduction in volume as the gas is converted to a liquified state, making it easy to store and transport. Another advantage of converting the produced natural gas to a liquified form is that the produced LNG can be economically stored to supplement energy suppliers during seasonal peak demand periods. Liquified natural gas, typically stored at atmospheric pressures and at temperatures of approximately −260° F., is transported to distant markets via refrigerated tankers.

Processes for the liquifaction of natural gas are well known in the art. Natural gas comprising predominantly methane enters an LNG plant at elevated pressures and is pretreated to produce a purified feed stock suitable for liquifaction at cryogenic temperatures. The pretreatment typically includes removal of acid gases, e.g., hydrogen sulfide and carbon dioxide, together with other contaminants, including moisture and mercury. The purified gas is thereafter processed through a plurality of cooling stages using indirect heat exchange with one or more refrigerants to progressively reduce its temperature until total liquifaction is achieved. The pressurized liquid natural gas is sub-cooled to reduce flashed vapor through one or more expansion stages to final atmospheric pressure suitable for storage and transportation. The flashed vapor from each expansion stage, together with the boil off gas produced as a result of heat gain, are collected and used as a source of plant fuel gas with any excess recycled to the liquifaction process.

Because a significant amount of refrigeration energy is required for liquifying natural gas, the refrigeration system becomes one of the major units in an LNG facility. Mechanical refrigeration cycles mostly in closed circuit are often employed in LNG projects. A number of liquifaction processes have been developed with the differences mainly found in the refrigeration cycles used. The most commonly used LNG processes can be classified into three categories as follows:

1) The cascade process presenting the benefits of easy start-up or shutdown. The cascade process consists of successive refrigeration cycles using propane, ethane or ethylene, and methane. The thermal efficiency can be readily enhanced by the use of multi-compressor stages. U.S. Pat. No. 5,669,234, incorporated herein by reference, represents an exemplary cascade process.
2) The propane pre-cooled mixed refrigerant process involves the use of a multi-component mixture of hydrocarbons, typically comprising propane, ethane, methane, and optionally other light components in one cycle, and a separate propane refrigeration cycle to provide pre-cooling of natural gas and the mixed refrigerant to approximately −35° F. The propane mixed refrigerant process advantageously provides improved thermal efficiency. However, a significant disadvantage results from the use of extremely large spiral wound exchangers. Such exchangers are a long lead item requiring special facilities in the field to manufacture. Examples of the propane mixed refrigerant process include those disclosed in U.S. Pat. Nos. 4,404,008 and 4,445,916, incorporated herein by reference.
3) The single, mixed refrigerant process includes heavier hydrocarbons, e.g., butanes and pentanes, in the multi-component mixture and eliminates the pre-cooled propane refrigeration cycle. It presents the simplicity of single compression in the heat exchanger line and is particularly advantageous for small LNG plants. U.S. Pat. No. 4,033,735, incorporated herein by reference, represents an exemplary single, mixed refrigerant process.

The use of a turbo expander in combination with mechanical refrigeration cycles has also been adopted in many LNG processes. Examples of the use of a turbo expander are disclosed in U.S. Pat. Nos. 3,724,226; 4,065,278; 5,755,114; 4,970,867, 5,537,827; and Int'l Patent No. WO 95/27179.

In addition to methane, natural gas typically contains various amounts of ethane, propane and heavier hydrocarbons. The composition varies significantly depending on the source of the gas and gas reserve characteristics. Hydrocarbons heavier than methane need to be removed from LNG for various reasons. Hydrocarbons heavier than pentane, including aromatics, having high freezing points must be reduced to an extremely low level to prevent the freezing and plugging of process equipment in the course of cooling and liquifaction steps. After separation of these heavy components from LNG, they provide excellent gasoline blending stock. Many patents have been directed to methods for removal of these heavy hydrocarbons. For instance, U.S. Pat. No. 5,325,673 discloses the use of a single scrub column in the pretreatment step operated substantially as an absorption column to remove freezable $C_{5+}$ components from a natural gas stream feeding to an LNG facility. The heavy liquid recovered subsequently can be fractionated into various fractions for use as make-up refrigerants. U.S. Pat. No. 5,737,940 describes an exemplary system incorporated in a cascade process.

Besides being liquified as part of LNG and used as fuel, lighter natural gas liquid (NGL) components, e.g., hydrocarbons having 2–4 carbon atoms, can also be a source of feedstock to refineries or petrochemical plants. Therefore, it is often desirable to maximize the recovery of NGL to enhance revenue. To achieve high recovery of these components, it is common practice to design an NGL recovery plant so that the tail gas produced by the NGL recovery plant and comprising primarily methane is delivered to the LNG facility for liquifaction. U.S. Pat. Nos. 5,291,736 and 5,950,453 are typical examples of such combined facilities.

Among several different NGL recovery processes, the cryogenic expansion process has become the preferred process for deep hydrocarbon liquid recovery. In a conventional turbo-expander process, the feed gas at elevated pressure is pretreated for the removal of acid gases, moisture and other contaminants to produce a purified feed stock suitable for further processing at cryogenic temperatures. The purified feed gas is then cooled to partial condensation by heat exchange with other process streams and/or external propane refrigeration, depending upon the richness of the gas. The condensed liquid after removal of the less volatile components is then separated and fed to a fractionation column, operated at medium or low pressure, to recover the heavy hydrocarbon constituents desired. The remaining non-condensed vapor portion is turbo-expanded to a lower pressure, resulting in further cooling and additional liquid condensation. With the expander discharge pressure typically the same as the column pressure, the resultant two-phase stream is fed to the top section of the fractionation column where the cold liquids act as the top reflux to enhance recovery of heavier hydrocarbon components. The remaining vapor combines with the column overhead as a residue gas, which is then recompressed to a higher pressure suitable for pipeline delivery or for liquifaction in an LNG facility after being heated to recover available refrigeration.

Because a column operated as described above acts mainly as a stripping column, the expander discharge vapor leaving the column overhead that is not subject to rectification still contains many heavy components. These components could be further recovered through an additional rectification step. Ongoing efforts attempting to achieve a higher liquid recovery have mostly concentrated on the addition of a rectification section and the generation of an enhanced reflux stream to the expanded vapor. Many patents exist purporting to disclose an improved design for recovering ethane and heavier components in an NGL plant. For example, see U.S. Pat. Nos. 4,140,504; 4,251,249; 4,278,457; 4,657,571; 4,690,702; 4,687,499; 4,851,020; and 5,568,737. At best, these processes are capable of recovering 95%+ of ethane and heavier hydrocarbons. However, they typically involve a significant capital expenditure during construction of the NGL plant as well as increased operational costs during its lifetime.

It will be recognized that all NGL components have higher condensing temperatures than methane so that all will be liquified in the course of operating an LNG process. A substantial cost savings may be realized, if the NGL recovery could be effectively integrated within the liquifaction process instead of building a separate facility.

Recovery of NGL in the LNG facility has also been suggested in the literature. For example, it has been suggested that lighter NGL components could be recovered in conjunction with the removal of $C_{5+}$ hydrocarbons by using a scrub column in a propane pre-cooled, mixed refrigerant process. See U.S. Pat. Nos. 4,445,917 and 5,325,673. A cryogenic stripping column in a cascaded process was suggested in U.S. Pat. No. 5,737,940 for recovery of heavy hydrocarbons from a natural gas feed stream. In a further modification, U.S. Pat. Nos. 5,950,453 and 5,016,665 disclose a method wherein a demethanizer is incorporated in the process for liquifying natural gas for recovering heavier hydrocarbon liquids.

The NGL recovery column in these systems is often required to operate at a relatively high pressure, typically above 550 psig, in order to maintain an efficient and economical utilization of mechanical refrigeration employed in the LNG process. While benefitting from lower refrigeration energy by maintaining a high liquifaction pressure, the separation efficiency within the recovery column may be significantly reduced due to less favorable separating conditions, i.e., lower relative volatility inside the column. In addition, prior art processes fail to effectively provide reflux to the recovery column. As a result, none of these processes are capable of efficiently maintaining a high NGL recovery, i.e., the NGL recovery does not typically exceed 80% with these processes.

As can be seen from the foregoing description, those skilled in the art have long sought methods and apparatus for improving the efficiency and economy of processes for separating and recovering ethane and heavier natural gas liquids in an NGL plant. While prior art methods have been capable of recovering more than 95% of the ethane and heavier hydrocarbons in a stand-alone NGL recovery plant, those processes fail to maintain the same recovery when integrated with an LNG facility. Accordingly, there has been a long felt but unfulfilled need for more efficient, more economical methods of integrating these processes while improving, or at least maintaining, their economics.

SUMMARY OF THE INVENTION

The present invention provides an integrated process for recovery of the components of a feed gas containing methane and heavier hydrocarbons while maximizing NGL recovery and minimizing capital expenditures and operating costs incurred with the LNG facility. The present invention is also intended to improve separation efficiency within an NGL recovery column while maintaining column pressure as high as practically possible to achieve an efficient and economical utilization of mechanical refrigeration in the liquifaction process. This is achieved by the introduction of an enhanced liquid reflux specifically suitable for the purpose of the recovery column.

Historically, the price of liquid ethane has been cyclical, rising and falling in response to the demand for use as petrochemical feed stock. When the price of liquid ethane is high, gas processors can generate additional revenues by increasing the recovery of ethane. On the other hand, when the ethane market is depressed, it may be desirable to effectively reject ethane, allowing it to remain in the LNG, but still maintain high recovery of propane and heavier components. Due to the cyclical nature of the liquid ethane market, designing a facility which can selectively and efficiently recover or reject ethane will allow producers to quickly respond to changing market conditions, a phenomenon that seems to occur ever more frequently in today's market. Accordingly, the present invention is designed to permit flexible transition between operation for ethane recovery or ethane rejection.

A number of liquifaction processes developed in the prior art have been described above. These processes may differ significantly depending on the mechanical refrigeration cycle used. The methods of the present invention may be integrated with any of those processes. The methods of the present invention are applicable independent of the type of mechanical refrigeration used in the LNG process.

The present invention, in the broadest sense, provides an integrated process and apparatus for cryogenically recovering ethane, propane and heavier components during natural gas liquifaction processes via a distillation column, in which the reflux derived from various sources in the liquifaction process is essentially free of the components to be recovered. The provision of an enhanced liquid reflux, which is lean on the NGL components, to the distillation column permits a high recovery of NGL components even when the column is operated at a relatively high pressure. The process involves introducing a cooled gas/condensate feed into a first distillation column, e.g., an NGL recovery column, at one or more feed trays. The gas/condensate feed is separated into a first liquid stream primarily comprising NGL components to be recovered and a methane rich overhead stream essentially free of NGL components. The methane-rich overhead stream is further cooled to total liquifaction. Preferably the liquified methane-rich stream is further sub-cooled. This liquified, and preferably sub-cooled, methane-rich stream under pressure is subsequently flashed to near atmospheric pressure in one or more steps with the liquid collected in the final flash step being delivered to the LNG tank for storage. The flashed vapor is heated and compressed to a higher pressure for delivery as fuel gas. Excess flashed vapor, if any, is recycled to the liquifaction process in which it is ultimately liquified as pressurized LNG or as liquid reflux to the NGL recovery column. The first liquid stream is introduced into a second distillation column, e.g., an NGL purifying column, at one or more feed trays. In the second column, the first liquid stream is separated into an NGL product stream from the bottom and a first vapor portion primarily comprising all of the remaining lighter components from the overhead.

In one embodiment of the present invention, the first vapor portion is combined with at least a portion of the excess flashed vapor. The combined stream is compressed and cooled to substantial condensation and thereafter introduced to the top of the NGL recovery column as a liquid reflux. This reflux stream will contain an extremely low concentration of the heavy components to be recovered in the NGL product. This stream enhances the recovery efficiency within the column and reduces the loss of NGL components in the methane-rich overhead stream to a minimum. A high NGL recovery is therefore achieved even with a relatively high operating pressure, i.e., a pressure of about 600 psig, for the NGL recovery column.

The economic advantages of the present invention can be further improved by thermally linking a side reboiler for the first distillation column with the overhead condenser for the second distillation column. More specifically, the first vapor portion is cooled in countercurrent heat exchange with a liquid withdrawn from a tray located below the feed trays of the first distillation column. The cooled first vapor portion is separated into a liquid fraction for introduction into the second distillation column as a top liquid reflux and a lighter, vapor fraction with further reduced NGL components for introduction into the first distillation column as a top reflux. Thus the NGL recovery efficiency in the second column is enhanced. The heat carried by the liquid withdrawn returns to the first distillation column where it provides a stripping action in the bottom portion of the column, thereby reducing volatile components, e.g., methane, in the first liquid stream from the bottom.

The recovery efficiency can be improved in another embodiment of the present invention by introduction of a second liquid reflux to the upper, rectification section of the first distillation column. The second reflux enters the distillation column preferably in the middle of the rectification section, as a middle reflux which provides a bulk rectification effect and reduces the NGL components to be recovered in the up-flow vapor stream. Any residual NGL components in the upward vapor stream can be recovered by the top and leaner liquid reflux. A slipstream from the feed gas can be taken and cooled to substantial condensation or even sub-cooling to form the second liquid reflux. In some cases, the feed gas contains much heavier components, e.g., hexane and aromatics, which tend to freeze at cryogenic temperatures. The feed gas can be first cooled to partial condensation where most of these components will be condensed in the liquid and separated out in a separator. A slipstream can then be taken from the non-condensed vapor portion and further cooled to substantial condensation to form the second liquid reflux. Optionally, this liquid reflux can be fed to the top of the NGL recovery column.

In another embodiment of the present invention, the top reflux to the first distillation column is generated by recycling a small portion of LNG under pressure prior to undergoing flashing. This reflux also has an extremely low content of the NGL components to be recovered and, accordingly, enhances separation efficiency. This reflux scheme can be advantageous for the liquifaction process where the LNG can be deeply sub-cooled using very cold mechanical refrigeration to reduce the vapor produced in the flashing steps to a minimum. Typical examples of this embodiment include liquifaction processes using mixed refrigerant with or without propane pre-cooling, cascaded refrigeration in a closed circuit.

Another feature providing a significant economic advantage in the present invention is the cooling of the feed gas by countercurrent heat exchange with a refrigerant stream comprising a portion of the first liquid stream or liquid withdrawn from the lower portion of the first distillation column. As a result, the refrigerant stream is partially vaporized and may be separated into a second liquid stream for introduction into the second distillation column and a second vapor stream for introduction into the first distillation column as a stripping gas after compression and cooling. The introduction of stripping gas supplements the heat requirements in the first distillation column for stripping volatile components off the first liquid stream. It also enhances the relative volatility of the key components and, accordingly, the separation efficiency in the column, particularly when the column is operated at a relatively high pressure as in the NGL recovery column of the present invention.

The methods and apparatus of the present invention efficiently integrate NGL recovery into the natural gas liquifaction process and permit high recoveries of propane and heavier components, e.g., recoveries exceeding 95% of those components originally present in the feed gas. In fact, the methods of the present invention, properly optimized, permit the recovery of at least 99% of the propane and heavier hydrocarbons originally found in the feed gas. The high recovery of heavier hydrocarbons achieved with the methods of the present invention may be advantageously used to clean gas feeds contaminated by cyclohexane, benzene and other heavy hydrocarbons which have been determined to create potential freezing problems and, accordingly, must be thoroughly removed. This high NGL recovery is achieved while eliminating the NGL plant, as typically employed in the prior art, in the front-end of the LNG facility. Thus, significant savings of capital, as well as operating costs, are achieved. In addition, the flexible design of the present invention permits an easy transition between operations designed to either recover or reject ethane in order to accommodate rapidly changing values of liquid ethane. The integration methods proposed in the present invention can also be easily adapted for use with any liquifaction process regardless the refrigeration system used.

BRIEF DESCRIPTION OF THE DRAWINGS

The application and advantages of the present invention will become more apparent by referring to the following detailed description in connection with the accompanying drawings, wherein.

While the invention will be described in connection with the presently preferred embodiment, it will be understood that this is not intended to limit the invention to that embodiment. To the contrary, it is intended to cover all alternatives, modifications and equivalents as may be included in the spirit of the invention as defined in the appended claims.

DETAILED DESCRIPTION OF THE INVENTION

The present invention permits the separation and recovery of substantially all of the NGL components, i.e., ethane, propane and heavier hydrocarbons, from a compressed natural gas in an LNG process. The present invention achieves these high recoveries while eliminating the need for a separate NGL plant in the front-end of the LNG facilities by introducing to the distillation column an enhanced liquid reflux having an extremely low content of the NGL components to be recovered. The introduction of lean reflux permits the column to be operated at higher pressures while still maintaining high recovery of NGL and, accordingly, the refrigeration system can be utilized more efficiently in the liquifaction process. As a result of this more efficient integration, the capital requirements, as well as operating costs, for recovering substantially all of the NGL components present in the feed gas in an LNG process may be greatly reduced.

The foregoing merely provides an exemplary description of the use of the present invention in a conventional system for liquifying inlet gas and should not be considered as limiting the methods of the present invention. While various values of temperature, pressure and composition are recited in association with the specific examples described below, those conditions are approximate and merely illustrative, and are not meant to limit the invention. For purposes of this invention, when the term lean reflux is used with respect to a distillation column, it refers to the components to be recovered in the bottom liquid stream. For example, a lean reflux for recovery of propane and heavy hydrocarbons means that the reflux stream has a low content of the cited components. Furthermore, with respect to the terms upper and lower as used with respect to a distillation column, these terms are to be understood as relative to one another, i.e., that withdrawal of a stream from an upper region of a column is at a higher position than a stream withdrawn from a lower region thereof. In an exemplary, but non-limiting embodiment, upper may refer to the upper half of a column, whereas lower may refer to the lower half of a column. In another embodiment, where the term middle is used, it is to be understood that a middle region is intermediate to an upper region and a lower region. However, where upper, middle, and lower are used to refer to a cryogenic distillation column, it should not be understood that the column is strictly divided into thirds by these terms.

Figure 1:
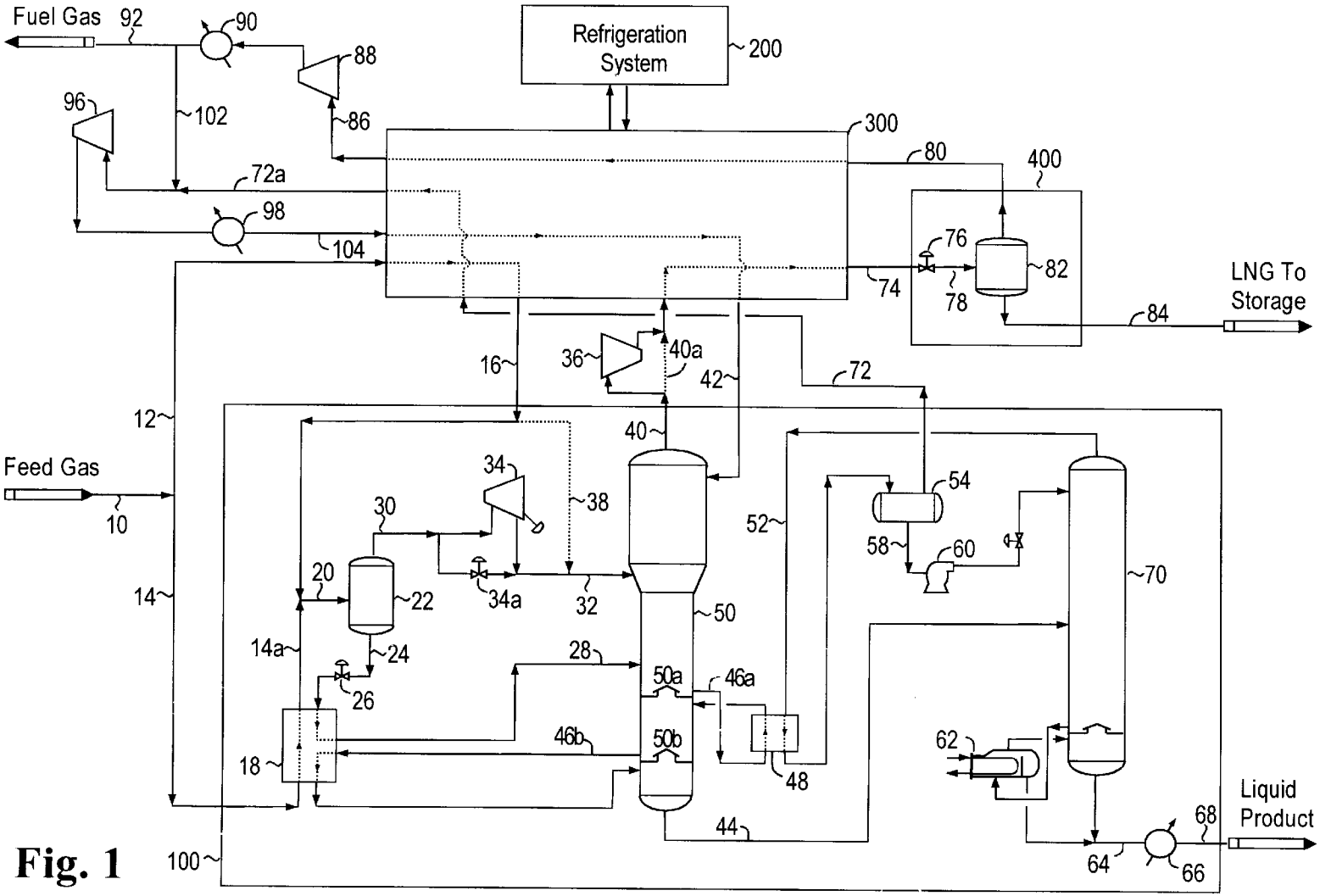
FIG. 1 illustrates a schematic representation of a system employing a natural gas liquifaction process incorporating the improvements of the present invention.

FIG. 1 illustrates a schematic configuration of one exemplary embodiment of the invention where at least about 95%, preferably above 98%, of the propane, propylene and heavier hydrocarbons, i.e., the $C_{3+}$ hydrocarbons, from a feed gas which will be ultimately liquified as LNG product may be recovered. Referring to FIG. 1, a dry feed gas at a flow rate of about 400 MMSCFD is introduced into the illustrated process through inlet stream 10 at a pressure of about 1000 psia and a temperature close to ambient, i.e., about 70° F. This dry feed gas stream has been pre-treated as necessary to remove undesirable components, including acid gases, mercaptans, mercury and moisture, from the natural gas delivered to the facility. Stream 10 is split into two streams 12 and 14. The smaller portion, stream 14, is directed through gas/liquid exchanger 18 in NGL recovery block 100 where it is in countercurrent heat exchange with liquid withdrawn from the bottom of NGL recovery column 50 and liquid from separator 22. This inlet gas provides heat for NGL recovery column 50, while chilling the inlet gas to a temperature of about −60° F. The larger portion of inlet gas, stream 12, flows to exchanger block 300 where it is cooled to about −42° F. by utilizing refrigeration in the liquifaction process. The cooling steps in the refrigeration system used in the liquifaction process may differ significantly, depending on the process used, and are collectively illustrated as simplified exchanger block 300, which will be described in more detail later.

Cooled feed gas stream 16 from exchanger block 300 is combined with the cooled feed gas 14*a* from gas/liquid exchanger 18. The combined stream 20 is directed and separated into liquid stream 24 comprising any condensed heavier hydrocarbons and into cooled vapor stream 30 comprising lighter and more volatile components in separator 22. Liquid stream 24 is expanded through expansion device 26 and preheated in gas/liquid exchanger 18 prior to introduction into a distillation column, e.g., NGL recovery column 50, as stream 28 for further fractionation. Depending upon feed gas composition and overall refrigeration, the preheating of expanded liquid stream 24 in exchanger 18 can be bypassed in some cases. Cooled vapor stream 30 flows to expander 34 where it is expanded to a pressure slightly above the operating pressure of NGL recovery column 50. Alternatively, the vapor in stream 30 may by-pass expander 34 through control valve 34*a*. Stream 32 from expander discharge at about −84° F. is fed to NGL recovery column 50 right below the upper rectifying section. It should be noted that, in cases where the feed gas pressure is close to the operating pressure of NGL recovery column 50, cooled stream 16 leaving exchanger block 300 can be directly fed to NGL recovery column as indicated in dashed line 38. Similarly, cooled feed gas 14*a* can be delivered directly to NGL recovery column 50 either alone or after being combined with the cooled gas in line 38.

The NGL recovery column operated at approximately 600 psia is a conventional distillation column containing a plurality of mass contacting devices, trays or packings, or some combinations of the above. It is typically equipped with one or more liquid draw trays in the lower section of the column to permit heat inputs to the column for stripping volatile components off from the bottom liquid product. Liquid collected in draw tray 50*a* is withdrawn via stream 46*a* and heated by countercurrent heat exchanger in side reboiler 48 prior to re-introduction to the NGL recovery column. Similarly, liquid condensed in the lower draw tray 50*b* is withdrawn via stream 46*b*, partially vaporized in gas/liquid exchanger 18, and re-introduced to the NGL recovery column.

The bottom liquid stream 44 containing substantially all of the heavier hydrocarbons is withdrawn from NGL recovery column 50 and directly introduced into the middle portion of a second distillation column, i.e., NGL purifying column 70. The liquid feed stream is separated in NGL purifying column 70 operated at a pressure of about 440 psia into an NGL product stream 64 comprising mainly propane, propylene and heavier hydrocarbons, i.e., the $C_{3+}$ hydrocarbons, and a vapor comprising mainly ethane and lighter hydrocarbons. The purity of the NGL product stream is controlled by external heat input via bottom reboiler 62. The NGL product stream exits column 70 at about 230° F. and is cooled to about 120° F. via exchanger 66 for delivery to product stream 68.

The vapor phase is withdrawn from the top of NGL purifying column 70 through overhead line 52. This vapor phase is cooled to partial condensation in side reboiler 48 prior to return to reflux drum 54 at a temperature of about −16° F. The heat carried by vapor stream 52 is effectively transferred to the NGL recovery column as external heat input. This is accomplished by a unique thermal integration between the overhead condenser and the side reboiler for NGL purifying column 70. The partially condensed stream is separated in reflux drum 54 into vapor and liquid phases. The liquid accumulated in reflux drum 54 is withdrawn via line 58 where it is pumped via reflux pump 60 for re-introduction to the NGL purifying column as top reflux.

The vapor phase withdrawn from reflux drum 54 via line 72 comprises mainly methane and ethane which were present in liquid feed stream 44. The concentration of propane and higher components in the vapor phase of line 72 is very low. This vapor phase is directed into exchanger block 300 for recovering available refrigeration. In cases where the available refrigeration is limited, stream 72 can bypass exchanger block 300 and simplify the exchanger block design. A combined stream formed by warmed stream 72*a* and excess flashed vapor 102, if any, is compressed to a higher pressure at about 625 psia in compressor 96 prior to being cooled in after-cooler 98. The cooled, combined vapor stream 104 returns to exchanger block 300 where it is further cooled to substantial condensation in stream 42 using refrigeration employed in the liquifaction process. The substantially condensed stream 42 is introduced to NGL recovery column 50 as top reflux. Reflux stream 42, characterized by a very low content of $C_{3+}$ hydrocarbons, reduces the equilibrium loss of $C_{3+}$ hydrocarbons in the overhead vapor to a minimum. The introduction of a lean reflux stream in the present invention permits the column to be operated at a relatively high pressure, e.g., about 600 psia in this example, while maintaining high recovery of $C_{3+}$ hydrocarbon liquids. It should be noted that the lean reflux stream 42 may also be the overhead vapor stream 72 from NGL purifying column 70 or a portion of flashed vapor 80 alone, or any combination of these two streams.

Lighter and more volatile gases primarily rich in methane are withdrawn from the top of NGL recovery column 50 via overhead stream 40. This stream is compressed in expander/compressor 36 utilizing work extracted from expander 34 before delivery to exchanger block 300. It should be noted that overhead stream 40 can be directly sent to exchanger block 300 without further compression as shown with dashed line 40*a* in cases where expander compressor 36 is not available or is used for other services.

The methane-rich overhead stream from NGL recovery column 50 at about −101° F. and about 600 psia is totally liquified and in most cases deeply sub-cooled in exchanger block 300 utilizing appropriate refrigeration from refrigeration block 200. Sub-cooled LNG at an elevated pressure is delivered via stream 74 from exchanger block 300 to expansion block 400 where it is expanded to near atmospheric pressure through one or more expansion steps. Expansion block 400 illustrates a typical arrangement with one expansion step. Sub-cooled LNG is expanded through expansion means 76 to about 20 psia causing partial vaporization in discharge line 78. An hydraulic turbine optionally can be employed as an expansion means to reduce flashing as a result of pressure reduction. Any flashed vapor in expanded LNG stream 78 is separated from the liquid portion in separator 82. The liquid portion withdrawn from separator 82 comprises LNG product 84 for delivery to storage. Although illustrated with a single expansion step, the expansion provided in expansion block 400 can also be carried out in multiple stages.

Flashed vapor 80 from separator 82, primarily comprising methane, nitrogen and other lighter components, enters exchanger block 300 for recovery of available cold refrigeration. The warmed, flashed vapor 86 leaves exchanger block 300 at about 65° F. and is compressed to a fuel gas at a pressure of about 420 psia via fuel gas compressor 88. The compressed vapor is then cooled to about 100° F. through after-cooler 90 prior to being used as fuel gas 92. It should be noted that, depending upon the pressures of the expansion steps and the final fuel gas supply pressure, more than one compression and cooling step may be required. Any portion of excess flashed vapor 102 may be combined with the warm vapor stream 72*a* for recycle to the top of NGL recovery column 50 as liquid reflux after being further compressed and cooled to substantial condensation.

Figure 2:
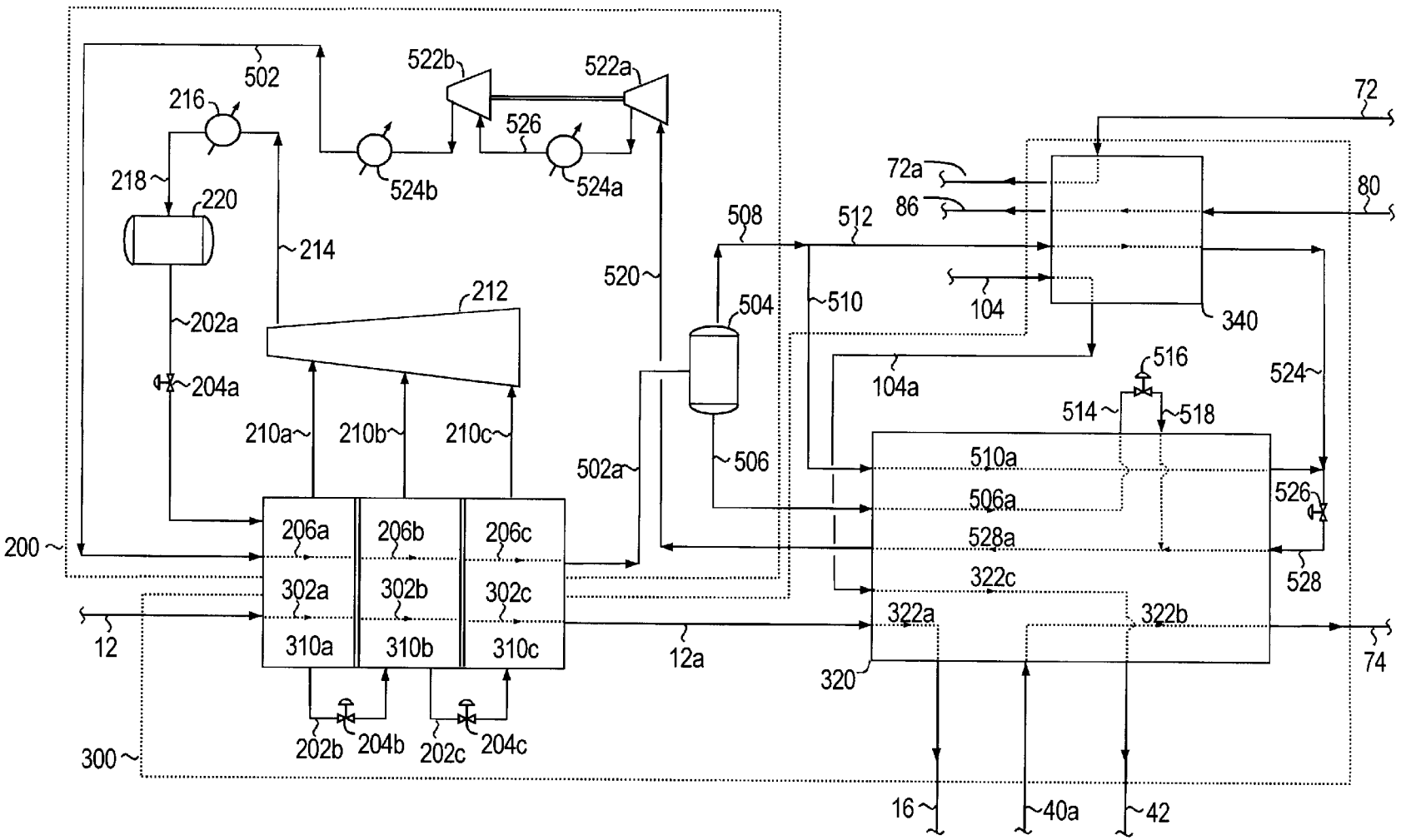
FIG. 2 illustrates a schematic representation of a system employing a typical propane pre-cooled, mixed refrigeration process incorporating the improvements of the present invention for liquifying natural gas.

As mentioned previously, mechanical refrigeration cycles mostly in closed circuit are often employed and dictate the detailed cooling and liquifaction steps in the LNG process. FIG. 2 illustrates in more detail a typical arrangement of exchanger block 300 and refrigeration block 200 utilizing the propane pre-cooled mixed refrigeration cycle in conjunction with the embodiment of the present invention illustrated in FIG. 1. An exemplary three-stage propane refrigeration circuit is illustrated. Referring to FIG. 2, propane refrigerant 202*a* withdrawn from propane surge drum 220 is directed to a pressure reduction device, e.g., expansion valve 204*a*, and expanded to a lower pressure, thereby flashing a portion of the propane refrigerant and lowering its temperature. The resulting two-phase stream is directed into high-stage propane chiller 310*a* as a coolant in indirect heat exchange with the main feed gas portion 12 and mixed refrigerant vapor 502 via conduits 302*a* and 206*a*, respectively.

The flashed propane vapor from chiller 310*a* is fed to the high-stage inlet port of propane compressor 212 through high-stage suction line 210*a*. The remaining liquid propane 202*b* is directed to pressure reduction valve 204*b* to further reduce its pressure, thereby flashing an additional portion of propane refrigerant and further lowering its temperature.

The resulting two-phase stream is directed into inter-stage propane chiller 310*b* as a coolant in indirect heat exchange with the cooled feed gas split from conduit 302*a* and mixed refrigerant vapor from conduit 206*a* via conduits 302*b* and 206*b*, respectively.

The flashed propane vapor from chiller 310*b* is fed to the inter-stage inlet port of propane compressor 212 through inter-stage suction line 210*b*. The remaining liquid propane 202*c* is further directed to pressure reduction valve 204*c* to reduce its pressure, thereby flashing another portion of propane refrigerant and lowering its temperature still further. The resultant two-phase stream is directed into low-stage propane chiller 310*c* as a coolant in indirect heat exchange with the cooled feed gas split from conduit 302*b* and mixed refrigerant vapor from conduit 206*b* via conduits 302*c* and 206*c*, respectively.

The flashed propane vapor from chiller 310*c* is fed to the low-stage inlet port of propane compressor 212 through low-stage suction line 210*c*. Propane vapor is compressed in three-stage propane compressor 212 typically driven by a gas turbine. Although they may be separate units tandem driven by a single driver, the three stages preferably form a single unit. Compressed propane vapor 214 flows through condenser 216 where it is liquified at about 100° F. and about 192psia in the illustrated system, prior to being returned via line 218 to propane surge drum 220. Exemplary temperatures for the three propane refrigeration levels, respectively, in the illustrated example are 60° F., 10° F., and −30° F.

Partially condensed, mixed refrigerant leaving conduit 206*c* via stream 502*a* from low-stage propane refrigeration is introduced into separator 504. The condensed portion is removed from the bottom of separator 504 as stream 506 at about −26° F. and about 640psia. Condensed refrigerant 506 is further cooled in exchanger 320 via conduit 506*a* to about −188° F. Sub-cooled refrigerant 514 is directed to a pressure reduction means, e.g., expansion valve 516, to lower the pressure. Expanded refrigerant 518 returns to exchanger 320 as a coolant.

Non-condensed vapor refrigerant 508 from separator 504 is divided into two portions 510 and 512. Main portion 510 flows through exchanger 320 where it is liquified and, optionally, sub-cooled to about −235° F. via conduit 510*a*. Remaining vapor portion 512 passes through exchanger 340 where it is liquified and sub-cooled in indirect heat exchange with flashed vapor stream 80 from expansion block 400 in FIG. 1. Other streams entering exchanger 340 include combined vapor stream 104 from after-cooler 98 and overhead vapor stream 72 from reflux drum 54 as depicted in FIG. 1. Inside exchanger 340, streams 72 and 80 are warmed before exiting exchanger 340 at about 65° F. as streams 72*a* and 86, respectively. On the other hand, stream 104 is cooled and exits exchanger 340 as stream 104*a* at about −26° F.

Sub-cooled refrigerant 524 exiting from exchanger 340 at about −245° F. is combined with the other sub-cooled refrigerant from conduit 510*a* and thereafter directed to a pressure reduction means, e.g., expansion valve 526, to a lower pressure before being returned to exchanger 320 as a coolant. After providing the coldest portion of refrigeration, expanded refrigerant 528 is combined with the other expanded refrigerant 518 in exchanger 320. The combined refrigerant provides the refrigeration necessary for cooling the following:

feed gas 12*a* from low-stage propane chiller 310*c;* methane-rich vapor stream 40*a* from NGL recovery column 50 in FIG. 1; and cooled vapor stream 104*a* from exchanger 340, via conduits 322*a*, 322*b*, and 322*c*, respectively.

Although not illustrated in FIG. 2, an hydraulic turbine may be used as a pressure reduction means for the sub-cooled refrigerant in place of expansion valves 516 or 526 illustrated therein. During the expansion process, work can also be extracted by a hydraulic turbine, thereby lowering the refrigerant temperature further and enhancing liquifaction efficiency and overall plant throughput.

After providing refrigeration, the combined mixed refrigerant exits exchanger 320 as warmed and vaporized stream 520 at about −30° F. and about 50psia. Warmed refrigerant 520 is then compressed and cooled. An exemplary compression and cooling configuration is illustrated in FIG. 2 with two stages. Stream 520 is first compressed to about 250psia via low stage refrigerant compressor 522*a* and then cooled to about 100° F. via low stage refrigerant after-cooler 524*a*. The cooled and compressed stream is further compressed and cooled to form stream 502 at about 655 psia and about 100° F. via high stage refrigerant compressor 522*b* and after-cooler 524*b*, thus completing the closed circuit.

Table 1 summarizes the inlet and overall performance of the embodiment of the invention illustrated above for a target recovery of $C_{3+}$ hydrocarbons exceeding 98%.

TABLE 1

| | | | Components Flow (lbmol/hr) | | | | | | |
|---|---|---|---|---|---|---|---|---|---|
| Stream | Temp ° F. | Pressure psia | methane | ethane | propane | butanes | C5+ | Non-hydrocarbons | total |
| 10 | 70 | 1000 | 39527 | 2152 | 1010 | 878 | 307 | 44 | 43918 |
| 32 | −84 | 608 | 36523 | 1629 | 544 | 299 | 51 | 42 | 39088 |
| 40 | −101 | 600 | 41877 | 2132 | 16 | 0 | 0 | 61 | 44086 |
| 68 | 120 | 440 | 0 | 20 | 994 | 878 | 307 | 0 | 2199 |
| 72 | −16 | 440 | 1495 | 1118 | 10 | 0 | 0 | 1 | 2624 |
| 84 | −251 | 20 | 35805 | 2131 | 16 | 0 | 0 | 16 | 37968 |
| 92 | 100 | 415 | 3722 | 1 | 0 | 0 | 0 | 27 | 3750 |

TABLE 1-continued

| Stream | Temp ° F. | Pressure psia | Components Flow (lbmol/hr) methane | ethane | propane | butanes | C5+ | Non-hydrocarbons | total |
|---|---|---|---|---|---|---|---|---|---|
| | | Liquid product recovery: | | | | | | | |
| | | % Propane recovery | | | | | | 98.4 | |
| | | % Butanes recovery | | | | | | 100.0 | |
| | | % C5+ recovery | | | | | | 100.0 | |
| | | Total compression brake horsepower | | | | | | | |
| | | Gas compression 88 and 96 | | | | | | 13,235 | |
| | | Refrigerant compression | | | | | | 107,150 | |
| | | Total | | | | | | 120,385 | |

As indicated in Table 1, recovery of 98.4% of propane and 100% of all $C_{4+}$ hydrocarbons can be achieved in the LNG process with the present invention. Total compression horsepower required for the integrated liquifaction process includes 13,235 BHP for fuel gas compressors 88 and 96, and 107,150 BHP for refrigerant compressors 212, 522*a* and 522*b*. This compares favorably with a total compression horsepower exceeding 125,000 HP required for a separate, up-front NGL plant to recover NGL components, followed by a liquifaction facility to produce LNG.

In addition to the propane pre-cooled, mixed, refrigeration cycle represented in FIG. 2, other mechanical refrigeration cycles for liquifying natural gas known to the art can also be integrated with the present invention. Alternative arrangements of exchanger block 300 and refrigeration block 200 utilizing other refrigeration cycles commonly employed in the LNG process are discussed below. The systems described herein merely provide exemplary illustrations of the use of the present invention with other refrigeration processes for liquifying inlet gas and should not be considered as limiting the methods of the present invention to the specific refrigeration processes described.

Figure 3:
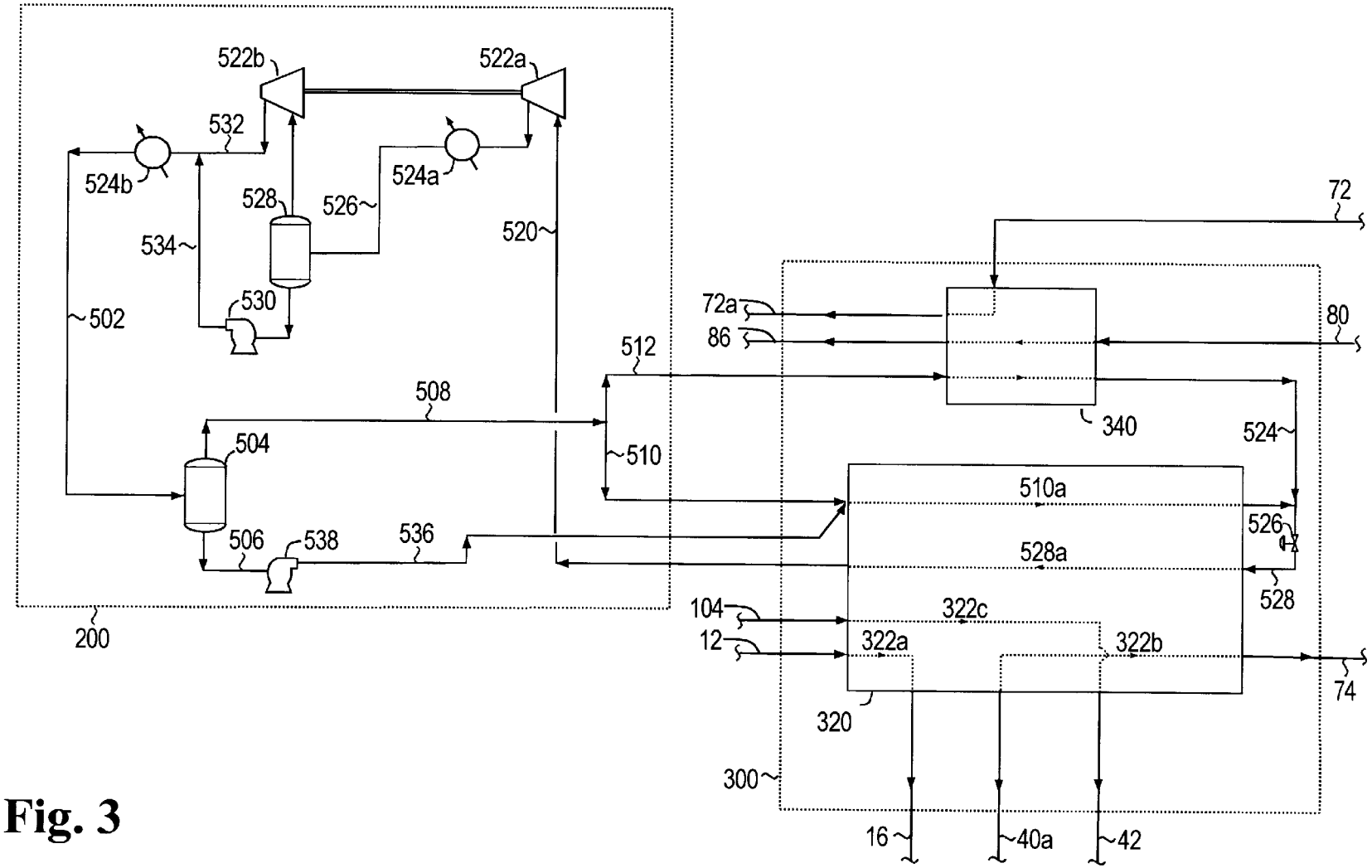
FIG. 3 illustrates a schematic representation of a system employing a typical single, mixed refrigeration process incorporating the improvements of the present invention for liquifying natural gas.

The single, mixed refrigerant process includes heavier hydrocarbons, e.g., butanes and pentanes, in the multi-component, mixed, refrigeration stream and eliminates the need for a propane pre-cooled refrigeration cycle. FIG. 3 illustrates the embodiment of the present invention as depicted in FIG. 1 further including the single, mixed, refrigeration process via exchanger block 300 and refrigeration block 200.

Referring to FIG. 3, mixed refrigerant 502 exits the final compression and cooling stage from high stage after-cooler 524*b* partially condensed as it contains some heavier components in the mixture. The partially condensed refrigerant 502 is introduced into separator 504 from which the condensed portion is removed from the bottom of the separator as stream 506. The non-condensed vapor refrigerant 508 from separator 504 is divided into two portions 510 and 512. The condensed refrigerant 506 is pumped via high stage refrigerant pump 538 as stream 536 for combination with the main vapor portion 510. The combined stream flows through exchanger 320 where it is liquified and in most cases sub-cooled in conduit 510*a*. The remaining vapor portion 512 passes through exchanger 340 where it is also liquified and sub-cooled in indirect heat exchange with the flashed vapor stream 80 from expansion block 400 and the overhead vapor stream 72 from reflux drum 54 as illustrated in FIG. 1. Streams 72 and 80 are warmed inside exchanger 340 before exiting as streams 72*a* and 86, respectively. Sub-cooled refrigerant 524 from exchanger 340 is combined with the other sub-cooled refrigerant exiting from conduit 510*a* in exchanger 320. The combined stream is then directed to a pressure reduction means, e.g., expansion valve 526, and expanded to a lower pressure for return to exchanger 320 as coolant stream 528. The combined refrigerant provides via conduit 528*a* the refrigeration necessary for cooling the following:

feed gas 12;

methane-rich vapor stream 40*a* from NGL recovery column 50 in FIG. 1; and combined vapor stream 104 from after-cooler 98 as depicted in FIG. 1.

via conduits 322*a*, 322*b*, and 322*c*, respectively.

Although not illustrated in FIG. 3, an hydraulic turbine may be used as a pressure reduction means for the sub-cooled refrigerant in place of expansion valve 526. During the expansion process, work may also be extracted by an hydraulic turbine, thereby lowering the refrigerant temperature further. Consequently, liquifaction efficiency and overall plant throughput are further enhanced. Alternatively, instead of being combined, liquid refrigerant 536 and vapor refrigerant 510 can enter exchanger 320 in separate paths and be expanded at different pressure levels.

After providing refrigeration, the mixed refrigerant exiting exchanger 320 has been warmed and vaporized to form stream 520. Warmed refrigerant 520 is then compressed and cooled again. FIG. 3 illustrates an exemplary two stage system for performing this compression and cooling. Stream 520 is first compressed via low stage refrigerant compressor 522*a* and then cooled via low stage refrigerant after-cooler 524*a*. Cooled refrigerant 526 is directed to high stage suction scrubber 528 for removal of any condensed refrigerant. The non-condensed refrigerant withdrawn from scrubber 528 is subsequently compressed to final pressure via high stage refrigerant compressor 522*b*. The condensed refrigerant separated in scrubber 528 is pumped via refrigerant pump 530 and conduit 534 for combination with compressed refrigerant 532. After passing through after-cooler 524*b*, it is cooled to form stream 502, thus completing the closed circuit.

Figure 4:
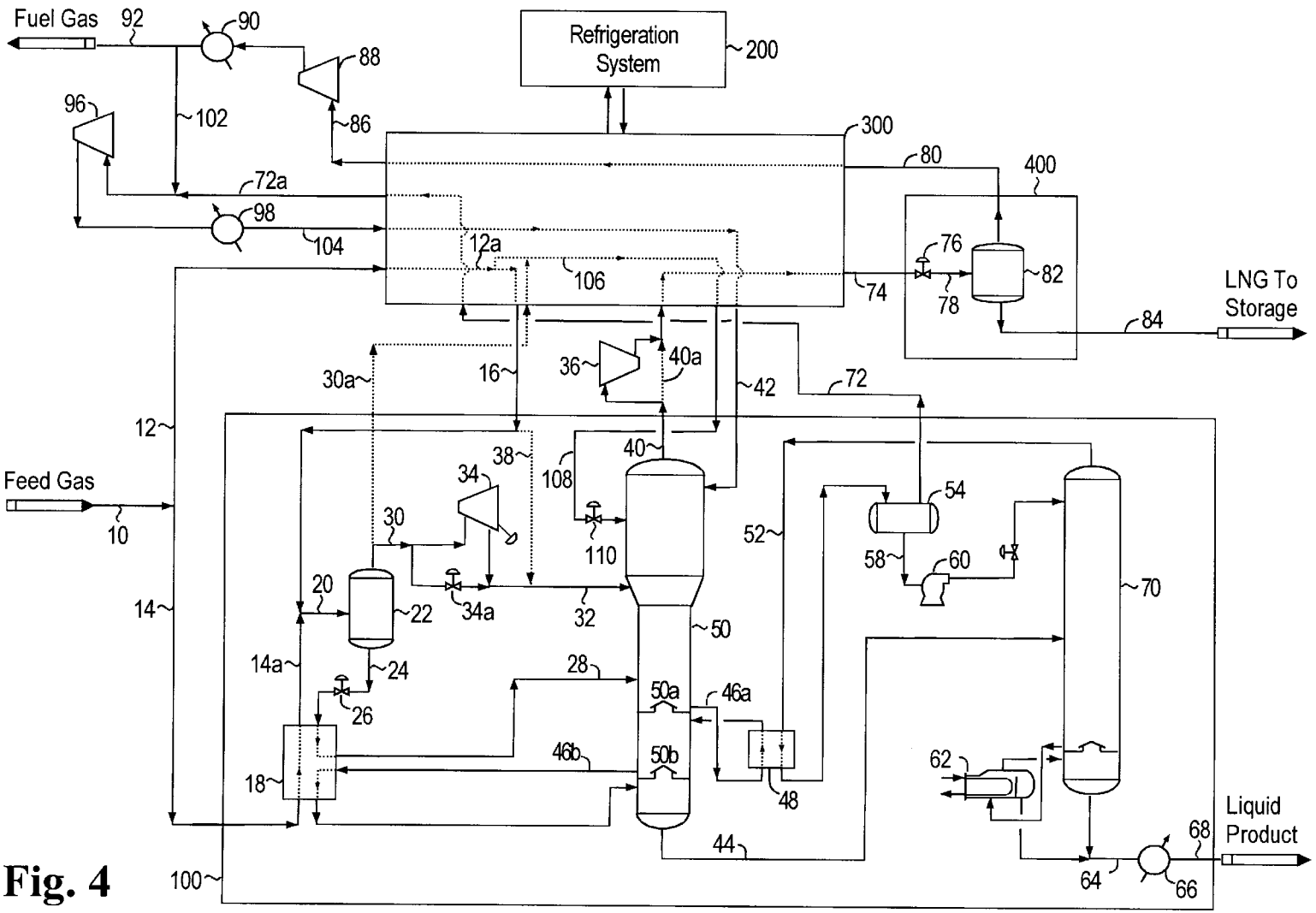
FIG. 4 illustrates an alternative embodiment of a system employing a natural gas liquifaction process incorporating the improvements of the present invention and introducing a second liquid reflux.

Recovery efficiency is further improved in another embodiment of the present invention wherein a second liquid reflux is introduced to the NGL recovery column. FIG. 4 represents a schematic embodiment illustrating this improvement to further enhance recovery efficiency. The system illustrated in FIG. 4 is essentially identical to that in FIG. 1 and operates in a similar manner with the exception of the differences detailed below. The same reference numerals have been used to represent the same system components in each figure.

With reference to FIG. 4, a small slipstream 106, about 12.5% in the illustrative example, from the pre-cooled feed gas stream 12*a* in exchanger block 300 is taken for further cooling to substantial condensation by utilizing appropriate refrigeration. In some cases, slipstream 106 may be sub-cooled depending upon the refrigeration level available for the liquifaction process. Sub-cooled stream 108 exits exchanger block 300 at about −170° F. and about 975 psia. Stream 108 is thereafter introduced into the middle of the rectification section of NGL recovery column 50 as a middle reflux after pressure reduction to the column pressure via expansion valve 110.

The introduction of a middle reflux provides a bulk rectification effect while substantially retaining the NGL components for recovery in the downward liquid flow, thereby minimizing the recoverable NGL components in the up-flow vapor stream. Any residual NGL components in the upward vapor can all be substantially recovered by the top and leaner liquid reflux. As a result, the same NGL recovery can be achieved with a significantly reduced top reflux flow. LNG stream 74 from exchanger block 300 can be further sub-cooled to reduce flashed vapor 80 from expansion block 400 to the minimum required for the fuel gas requirements. Consequently, the excess flash vapor flow 102 can be eliminated, leading to a substantial reduction in the compression HP required for fuel gas compressor 88. Thus, overall recovery efficiency can be significantly enhanced.

In some cases, the feed gas contains much heavier components, e.g., hexane, $C_{6+}$ alkanes and aromatics, which tend to freeze when cooled to cryogenic temperatures, in particular temperatures below −120° F. For those cases, slipstream 30*a* taken from the vapor portion withdrawn from the top of separator 22 as illustrated with a dashed line in FIG. 4 can be used as stream 106. The feed gas is pre-cooled to a temperature where most of the components having high freezing points are condensed and separated in the liquid phase in separator 22. The vapor stream withdrawn from separator 22 comprises very few of these high freezing point components, thus eliminating the concerns of freezing.

An example employing the embodiment illustrated in FIG. 4 is demonstrated using the same inlet gas and conditions for the example using FIG. 1 and reported in Table 1. Table 2 below summarizes the overall performance of an LNG process incorporating a second reflux stream as described with reference to FIG. 4.

TABLE 2

| | | | Components Flow (lbmol/hr) | | | | | | |
|---|---|---|---|---|---|---|---|---|---|
| Stream | Temp ° F. | Pressure psia | methane | ethane | propane | butanes | C5+ | Non-hydrocarbons | total |
| 10 | 70 | 1000 | 39527 | 2152 | 1010 | 878 | 307 | 44 | 43918 |
| 32 | −83 | 608 | 33702 | 1512 | 508 | 281 | 48 | 39 | 36090 |
| 40 | −100 | 600 | 39532 | 2132 | 9 | 0 | 0 | 44 | 41717 |
| 68 | 120 | 440 | 0 | 20 | 1001 | 878 | 307 | 0 | 2206 |
| 72 | −4 | 440 | 1382 | 1475 | 11 | 0 | 0 | 1 | 2869 |
| 84 | −251 | 20 | 35805 | 2131 | 9 | 0 | 0 | 16 | 37961 |
| 92 | 100 | 415 | 3722 | 1 | 0 | 0 | 0 | 27 | 3750 |
| | | Liquid product recovery: | | | | | | | |
| | | % Propane recovery | | | | | | 99.1 | |
| | | % Butanes recovery | | | | | | 100.0 | |
| | | % C5+ recovery | | | | | | 100.0 | |
| | | Total compression brake horsepower | | | | | | | |
| | | Gas compression 88 and 96 | | | | | | 7,600 | |
| | | Refrigerant compression | | | | | | 112,365 | |
| | | Total | | | | | | 119,965 | |

As indicated in Table 2, propane recovery is improved to 99.1%. Total compression HP required for the integrated liquifaction process reduces to 119,965 BHP with 7600 BHP for fuel gas compressors 88 and 96, and 112,365 BHP for refrigerant compressors 212, 522*a* and 522*b*.

It should also be noted that the second liquid reflux may be fed to the top of the NGL recovery column alone or in combination with the other top reflux stream 42. While this will simplify the design of the upper rectification section, the recovery efficiency may be reduced slightly.

Figure 5:
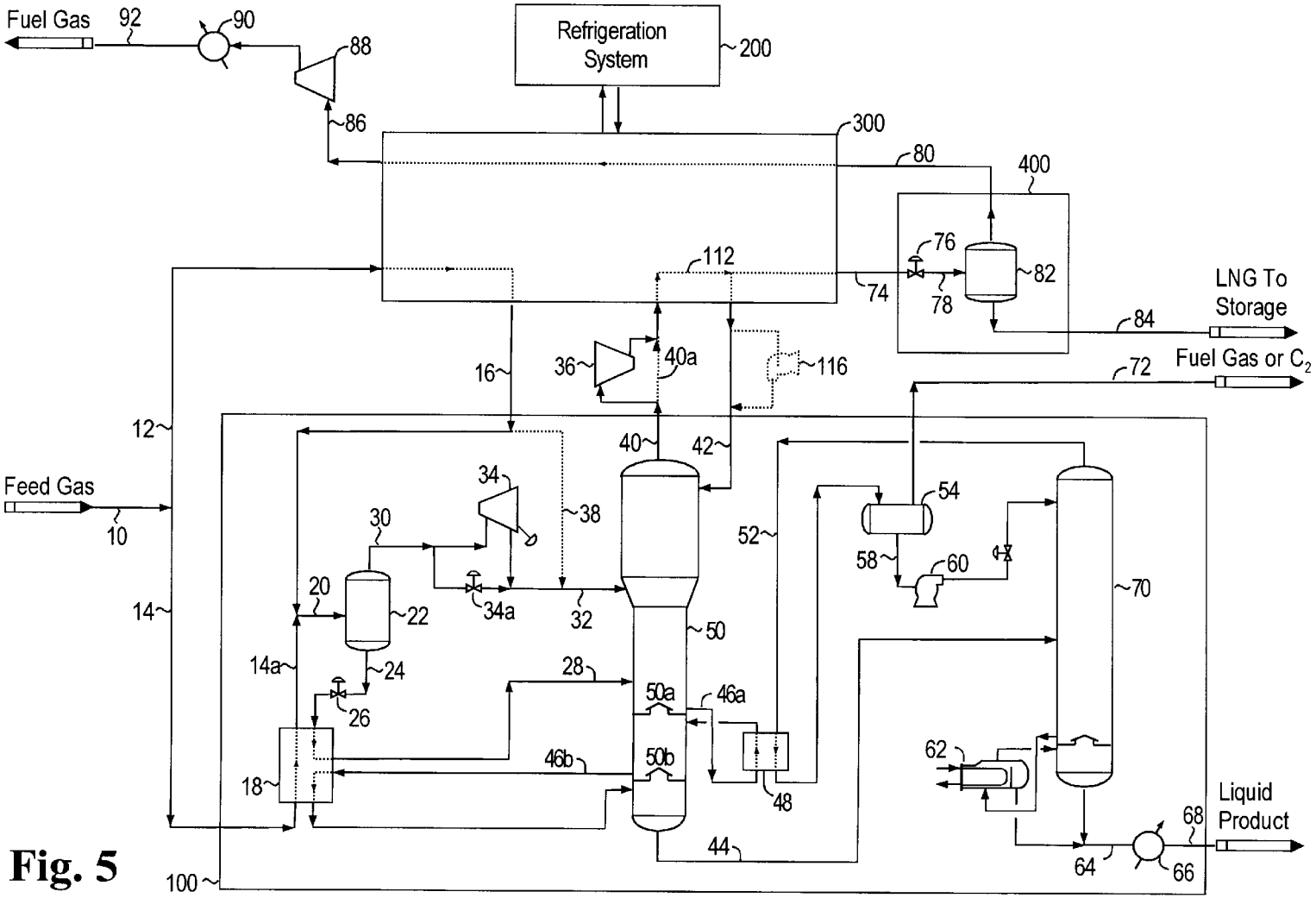
FIG. 5 illustrates another alternative embodiment of a system employing a natural gas liquifaction process incorporating the improvements of the present invention and introducing as a liquid reflux a portion of liquified natural gas recycled under pressure.

In yet another embodiment of the present invention, illustrated in FIG. 5, high recovery of NGL components can also be achieved by recycling a portion of the sub-cooled LNG at elevated pressure as the top liquid reflux to NGL recovery column 50. The LNG stream, again containing a very low content of NGL components, serves as an enhanced lean reflux to achieve high recovery efficiency in this embodiment. The system illustrated in FIG. 5 is essentially the same as that illustrated in FIG. 1 and operates in a similar manner. The difference resides in the source of the top feed (reflux) to NGL recovery column 50.

Referring to FIG. 5, lighter and more volatile methane-rich gases 40 withdrawn from the overhead of NGL recovery column 50 are totally liquified and, in most cases, sub-cooled in exchanger block 300 via conduit 112. Appropriate refrigeration from refrigeration block 200 is used for this liquifaction and sub-cooling. Prior to introduction into exchanger block 300, methane-rich overhead stream 40 may be raised in pressure via expander/compressor 36 utilizing work extracted from expander 34 when available as previously described. At least a portion of the sub-cooled LNG is re-introduced to the top of NGL recovery column 50 as reflux via line 42. In some cases where the expander/compressor 36 is not present, a cryogenic pump 116 may be used to return this liquid reflux to the top of the recovery column as illustrated in dashed line.

The main portion of sub-cooled LNG is further cooled before exiting the exchanger block 300 as stream 74 at a much colder temperature of about −242° F. Accordingly, flashed vapor flow 80 from expansion block 400 is greatly reduced before being directed to the fuel gas system after recovering refrigeration and compression. Additional heat input is provided to the lower stripping section of recovery column 50 to further strip lighter components off bottom liquid stream 44. This also leads to a reduction in overhead vapor 72 from reflux drum 54 associated with NGL purifying column 70. This overhead vapor stream 72 is also directed to the fuel gas system. Further, a second liquid reflux such as that disclosed in FIG. 4 may be incorporated to further improve recovery efficiency as illustrated previously.

While the integration of NGL recovery in an LNG facility in accord with the present invention has been demonstrated effectively for high $C_{3+}$ recovery, the aforementioned methods can also be easily modified by adjusting the operating parameters either for enhanced ethane recovery or for the recovery of $C_{5+}$ components alone in cases where recovery of lighter NGL components is not desirable. To achieve high ethane recovery, the temperature profile inside NGL recovery block 100 typically needs to be reduced, the reflux stream needs to be leaner and the flow should be increased. Table 3 summarizes the results of the operation of the system illustrated in FIG. 1 under ethane recovery conditions with the same feed gas composition and conditions as used in FIG. 1. As illustrated, ethane recovery above 84% is achieved using the process of the present invention illustrated in FIG. 1, but optimized for enhanced ethane recovery.

TABLE 3

| | | | Components Flow (lbmol/hr) | | | | | | |
|---|---|---|---|---|---|---|---|---|---|
| Stream | Temp ° F. | Pressure psia | methane | ethane | propane | butanes | C5+ | Non-hydrocarbons | total |
| 10 | 70 | 1000 | 39527 | 2152 | 1010 | 878 | 307 | 44 | 43918 |
| 32 | −111 | 588 | 13680 | 517 | 177 | 115 | 28 | 18 | 14535 |
| 40 | −122 | 580 | 42566 | 333 | 7 | 0 | 0 | 65 | 42971 |
| 68 | 120 | 440 | 36 | 1819 | 1003 | 878 | 307 | 1 | 4044 |
| 72 | −102 | 440 | 1162 | 87 | 0 | 0 | 0 | 1 | 1250 |
| 84 | −252 | 20 | 35768 | 333 | 7 | 0 | 0 | 15 | 36123 |
| 92 | 100 | 415 | 3723 | 0 | 0 | 0 | 0 | 27 | 3750 |
| | | Liquid product recovery: | | | | | | | |
| | | % Ethane recovery | | | | | | 84.5 | |
| | | % Propane recovery | | | | | | 99.3 | |
| | | % Butanes recovery | | | | | | 100.0 | |
| | | % C5+ recovery | | | | | | 100.0 | |
| | | Total compression brake horsepower | | | | | | | |
| | | Gas compression 88 and 96 | | | | | | 14,770 | |
| | | Refrigerant compression | | | | | | 119,670 | |
| | | Total | | | | | | 134,440 | |

Figure 6:
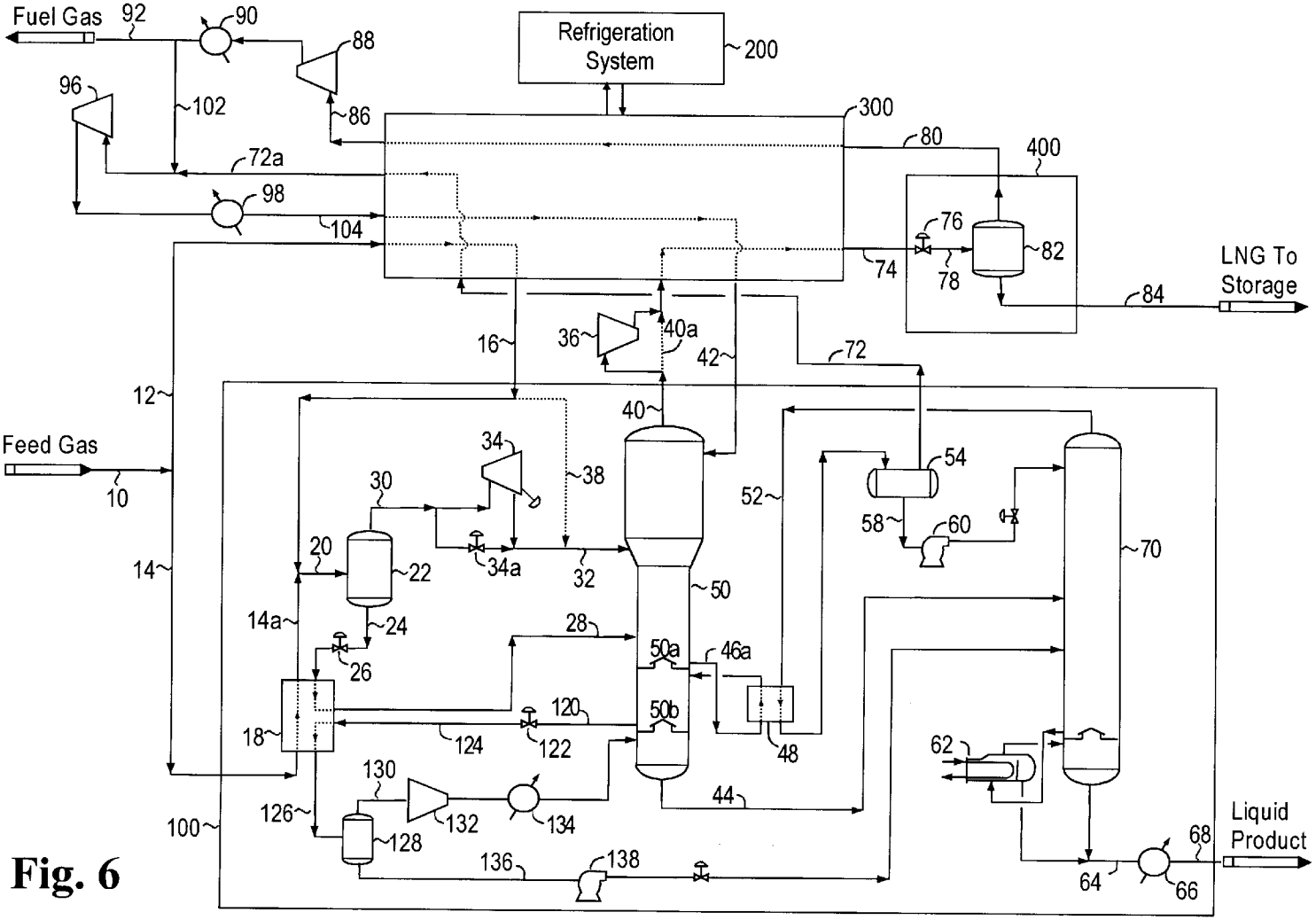
FIG. 6 illustrates another alternative embodiment of a system employing a natural gas liquifaction process incorporating the improvements of the present invention and introducing a stripping gas refrigeration system.

Another aspect of the present invention which offers a significant economic advantage is the cooling of the feed gas by countercurrent heat exchange with a refrigerant stream comprising a portion of bottom liquid stream 44 or liquid withdrawn from the lower portion of NGL recovery column 50. Illustrated in FIG. 6 is an alternative arrangement of a cryogenic NGL recovery process incorporating this modification. A side liquid is withdrawn from the lower portion of NGL recovery column 50 via line 120. This liquid is directed to pressure reduction valve 122 to reduce its pressure and thereby flash a portion of the liquid refrigerant. Expanded liquid refrigerant 124 at a lower temperature flows through gas/liquid exchanger 18 to provide additional refrigeration to cool inlet gas portion 14. Stream 126 carries the partially vaporized liquid exiting exchanger 18 to suction knockout drum 128 where it is separated into vapor and liquid portions. The vapor portion withdrawn from the top of knockout drum 128 through line 130 is directed to recycle compressor 132 where it is compressed to a pressure slightly higher than that of the NGL recovery column. The compressed gas from compressor 132 is cooled in cooler 134 prior to re-introduction to NGL recovery column 50 as a stripping gas.

The liquid portion accumulated at the bottom of knockout drum 128 is withdrawn via line 136. This liquid portion, comprising primarily propane and heavier hydrocarbons, is pumped by recycle pump 138 to NGL purifying column 70 for further fractionation.

The introduction of stripping gas (sometimes referred to as enrichment gas) supplements the heat requirements in NGL recovery column 50 for stripping volatile components from the bottom liquid stream 44. It also enhances the relative volatility of the key components and, accordingly, improves the separation efficiency of the column, particularly when the column is operated at a relatively high pressure as in the NGL recovery column illustrated here.

Figure 7:
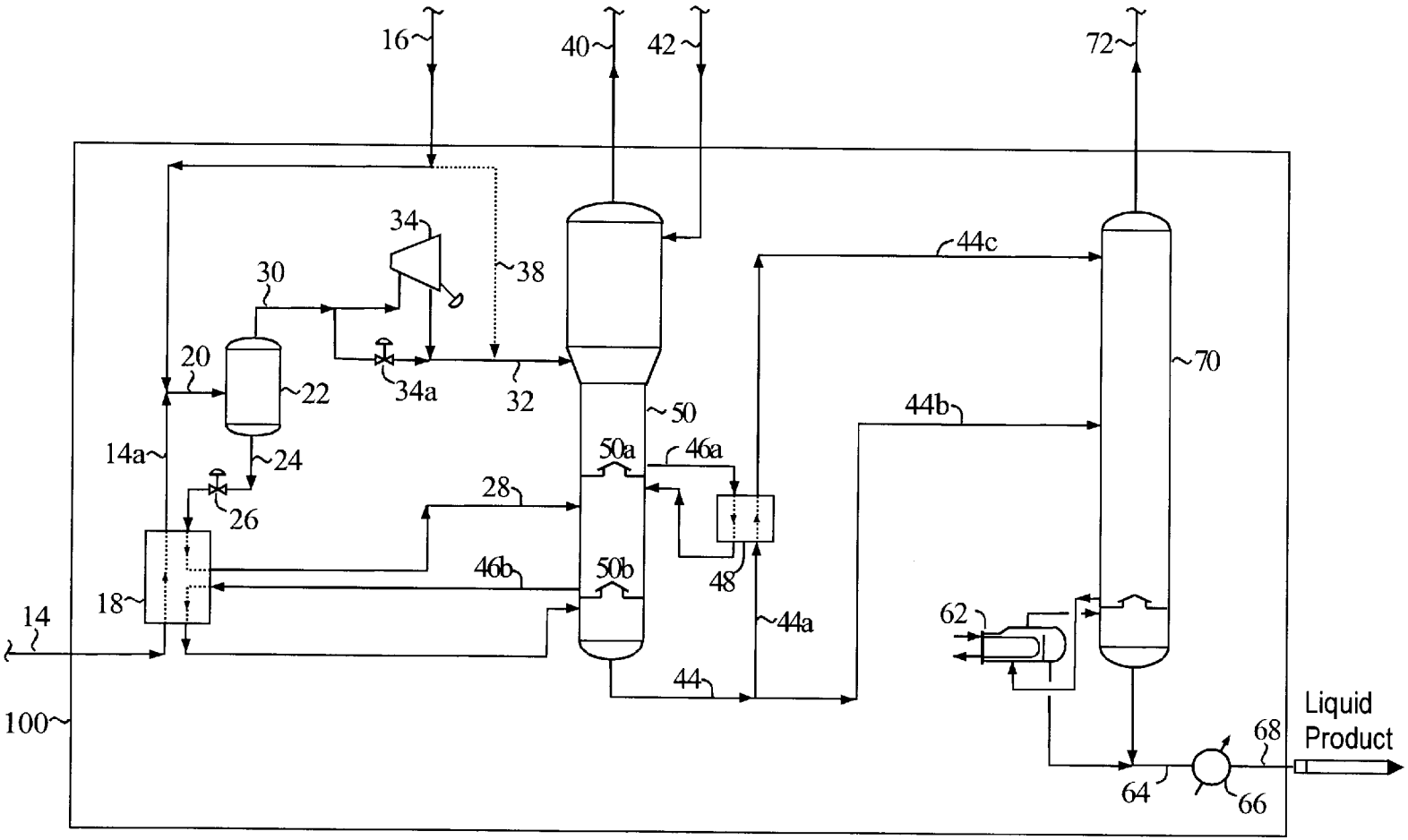
FIG. 7 illustrates another alternative embodiment of a system employing a natural gas liquifaction process incorporating the improvements of the present invention and employing a simplified NGL purifying system.

Yet another embodiment of the present invention is illustrated in FIG. 7. The NGL purifying system can be simplified by eliminating the overhead reflux system, resulting in savings on capital investment. Referring to FIG. 7 where only NGL recovery block 100 is illustrated, bottom liquid stream 44 from NGL recovery column 50 is split into two portions. One portion 44*b* is directly introduced into the middle portion of the NGL purifying column 70, as illustrated in FIGS. 1, 4, 5 and 6. The other portion 44*a* is directed to reflux exchanger 48 where it is substantially sub-cooled. The sub-cooled liquid 44*c* from reflux exchanger 48 is introduced to the top of NGL purifying column 70 as liquid reflux to reduce the equilibrium loss of heavy hydrocarbons in vapor stream 72. An exemplary source for the cold stream for reflux exchanger 48 is a liquid side-draw from NGL recovery column 50 as illustrated in FIG. 7. Consequently, the reflux drum and pumps can be eliminated.

In the foregoing specification, the invention has been described with reference to specific embodiments thereof, and has been demonstrated as effective in providing methods for maximizing the recovery of NGL components from a natural gas stream within an LNG facility. However, it will be evident to those skilled in the art that various modifications and changes can be made thereto without departing from the true spirit or scope of the invention. Accordingly, the specification is to be regarded in an illustrative rather than a restrictive sense. There may be other ways of configuring and/or operating the integration system of the present invention differently or in association with different liquifaction processes from those explicitly described herein which nevertheless fall within the true spirit and scope of the invention. For example, it is anticipated that by routing certain streams differently or by adjusting operating parameters, different optimizations and efficiencies may be obtained which would nevertheless not cause the system to fall outside of the scope of the present invention. Additionally, it must also be noted that, while the foregoing embodiments have been described in considerable detail for the purpose of disclosure, many variations, e.g., the arrangement and number of heat exchangers and compression stages, may be made therein. Therefore, the invention is not restricted to the preferred embodiments described and illustrated but covers all modifications which may call within the scope of the appended claims.

What is claimed is:

1. A process for recovering the relatively less volatile components from a methane-rich gas feed under pressure to produce an NGL product while rejecting the relatively more volatile components which are subsequently liquified to produce LNG, comprising the steps of:

cooling at least a portion of a gas feed in one or more heat exchangers by means of a mechanical refrigeration cycle;

introducing said gas feed into an NGL recovery column at one or more feed stages for separation into a first gas stream primarily comprising relatively more volatile components and a first liquid stream primarily comprising relatively less volatile components;

introducing said first liquid stream into an NGL purifying column at one or more feed stages to produce an NGL product stream comprising desirable less volatile components from the bottom and a second gas stream comprising more volatile components from the overhead of said NGL purifying column;

cooling said second gas stream and thereafter introducing said cooled, second gas stream to the top portion of said NGL recovery column as an overhead reflux to enhance recovery of desirable less volatile components; and liquefying said first gas stream to produce a pressurized LNG stream, wherein at least one mechanical refrigeration cycle is used in the cooling of said second gas stream and in the liquefying of said first gas stream.

2. The process of claim 1 wherein the step of cooling and introducing said gas feed into the NGL recovery column further comprises:

separating said cooled gas feed into a cooled vapor portion and a cooled liquid portion comprising condensed components, if any;

dividing said cooled vapor portion into a first vapor portion and a second vapor portion;

further cooling said first vapor portion to substantial condensation and thereafter introducing said substantially condensed first vapor portion into an upper portion of said NGL recovery column as a middle reflux; and introducing the remaining portion of said cooled gas feed comprising said second vapor portion and said cooled liquid portion into said NGL recovery column at one or more feed stages for separation into a first gas stream primarily comprising relatively more volatile components rich in methane and a first liquid stream primarily comprising relatively less volatile components.

3. The process of claim 1 or 2 wherein said mechanical refrigeration cycle includes a refrigerant selected from the group consisting of single-component refrigerants and multi-component refrigerants.

4. The process of claim 1 or 2 wherein a refrigeration stream is withdrawn from said NGL recovery column to provide at least a portion of the refrigeration in said first cooling step.

5. The process of claim 4 wherein said refrigeration stream is partially vaporized as a result of said cooling and further comprising separating said partially vaporized refrigeration stream into a first gas phase which is re-introduced into said NGL recovery column and a first liquid phase.

6. The process of claim 1 or 2 wherein said second gas stream is cooled to partial condensation with the condensed liquid being introduced to a top portion of said NGL purifying column as an overhead reflux and the remaining vapor being introduced to a top portion of said NGL recovery column as an overhead reflux after further cooling.

7. The process of claim 6 wherein said second gas stream is cooled by a refrigeration stream withdrawn from said NGL recovery column.

8. A process for recovering the relatively less volatile components from a methane-rich gas feed under pressure to produce an NGL product while rejecting the relatively more volatile components which are subsequently liquified to produce LNG, comprising the steps of:

cooling at least a portion of a gas feed in one or more heat exchangers by means of a mechanical refrigeration cycle;

introducing said gas feed into an NGL recovery column at one or more feed stages for separation into a first gas stream primarily comprising relatively more volatile components and a first liquid stream primarily comprising relatively less volatile components;

introducing said first liquid stream into an NGL purifying column at one or more feed stages to produce an NGL product stream comprising desirable less volatile components from the bottom and a second gas stream comprising more volatile components from the overhead of said NGL purifying column;

cooling said second gas stream and thereafter introducing said cooled, second gas stream to the top portion of said NGL recovery column as an overhead reflux to enhance recovery of desirable less volatile components;

liquefying said first gas stream to produce a pressurized LNG stream;

expanding said pressurized LNG stream in one or more expanding stages to produce an LNG stream suitable for storage; and producing a portion of said overhead reflux from a portion of the flashed vapor generated in one or more of said expanding stages.

9. A process for recovering the relatively less volatile components from a methane-rich gas feed under pressure to produce an NGL product while rejecting the relatively more volatile components which are subsequently liquified to produce LNG, comprising the steps of:

cooling at least a portion of a gas feed in one or more heat exchangers by means of a mechanical refrigeration cycle;

introducing said gas feed into an NGL recovery column at one or more feed stages for separation into a first gas stream primarily comprising relatively more volatile components and a first liquid stream primarily comprising relatively less volatile components;

introducing said first liquid stream into an NGL purifying column at one or more feed stages to produce an NGL product stream comprising desirable less volatile components from the bottom and a second gas stream comprising more volatile components from the overhead of said NGL purifying column;

compressing and then cooling said second gas stream;

introducing said compressed, cooled, second gas stream to the top portion of said NGL recovery column as an overhead reflux to enhance recovery of desirable less volatile components; and liquefying said first gas stream to produce a pressurized LNG stream.

10. A process for recovering the relatively less volatile components from a methane-rich gas feed to produce an NGL product while rejecting the relatively more volatile components which are subsequently liquified to produce LNG, comprising the steps of:

cooling at least a portion of a gas feed in one or more heat exchangers by means of a mechanical refrigeration cycle;

further cooling a portion of said cooled gas feed with mechanical refrigeration to substantial condensation and thereafter introducing said substantially condensed gas feed into the top of an NGL recovery column as an overhead reflux;

introducing the remaining portion of said cooled gas feed into said NGL recovery column at one or more feed stages for separation into a first gas stream primarily comprising relatively more volatile components rich in methane and a first liquid stream primarily comprising relatively less volatile components;

introducing said first liquid stream into an NGL purifying column at one or more feed stages to produce an NGL product stream comprising desirable less volatile components from the bottom and a second gas stream comprising more volatile components from the overhead of said NGL purifying column; and liquefying said first gas stream utilizing at least one mechanical refrigeration cycle to produce a pressurized LNG stream.

11. The process of claim 10 wherein the step of cooling and introducing said gas feed into the NGL recovery column further comprises:

separating said cooled gas feed into a cooled vapor portion and a cooled liquid portion comprising condensed components, if any;

dividing said cooled vapor portion into a first vapor portion and a second vapor portion;

further cooling said first vapor portion with mechanical refrigeration to substantial condensation and thereafter introducing said substantially condensed first vapor portion into an upper portion of said NGL recovery column as an overhead reflux; and introducing the remaining portion of said cooled gas feed comprising said second vapor portion and said cooled liquid portion into said NGL recovery column at one or more feed stages for separation into a first gas stream primarily comprising relatively more volatile components rich in methane and a first liquid stream primarily comprising relatively less volatile components.

12. The process of claim 10 or 11 wherein a refrigeration stream is withdrawn from said NGL recovery column to provide at least a portion of the refrigeration in said first cooling step.

13. The process of claim 12 wherein said refrigeration stream is partially vaporized as a result of said cooling and further comprising separating said partially vaporized refrigeration stream into a first gas phase which is re-introduced into said NGL recovery column and a first liquid phase.

14. The process of claim 10 wherein said mechanical refrigeration cycle includes a refrigerant selected from the group consisting of single-component refrigerants and multi-component refrigerants.

15. A process for recovering the relatively less volatile components from a methane-rich gas feed to produce an NGL product while rejecting the relatively more volatile components which are subsequently liquified to produce LNG, comprising the steps of:

cooling at least a portion of a gas feed in one or more heat exchangers by means of a mechanical refrigeration cycle;

separating said cooled gas feed into a cooled vapor portion and a cooled liquid portion comprising condensed components, if any;

dividing said cooled vapor portion into a first vapor portion and a second vapor portion;

further cooling said first vapor portion with mechanical refrigeration to substantial condensation and thereafter introducing said substantially condensed first vapor portion into an NGL recovery column as a reflux;

introducing the remaining portion of said cooled gas feed comprising said second vapor portion and said cooled liquid portion into said NGL recovery column at one or more feed stages for separation into a first gas stream primarily comprising relatively more volatile components rich in methane and a first liquid stream primarily comprising relatively less volatile components;

introducing said first liquid stream into an NGL purifying column at one or more feed stages to produce an NGL product comprising desirable less volatile components from the bottom and a second gas stream comprising more volatile components from the overhead of said NGL purifying column;

liquefying said first gas stream utilizing at least one mechanical refrigeration cycle to produce a pressurized LNG stream; and introducing at least a portion of said pressurized LNG stream to the top of said NGL recovery column as an overhead reflux to enhance recovery of relatively less volatile components.

16. A process for recovering the relatively less volatile components from a methane-rich gas feed under pressure to produce an NGL product while rejecting the relatively more volatile components which are subsequently liquified to produce LNG, comprising the steps of:

cooling at least a portion of a gas feed in one or more heat exchangers by means of a mechanical refrigeration cycle;

introducing said cooled gas feed into an NGL recovery column at one or more feed stages for separation into a first gas stream primarily comprising relatively more volatile components and a first liquid stream primarily comprising relatively less volatile components;

introducing said first liquid stream into an NGL purifying column at one or more feed stages to produce an NGL product stream comprising desirable less volatile components from the bottom and a second gas stream comprising more volatile components from the overhead of said NGL purifying column;

liquefying said first gas stream to produce a pressurized LNG stream;

expanding said pressurized LNG stream in one or more stages to a lower pressure to produce an LNG stream suitable for storage and at least one flashed vapor stream; and compressing and cooling at least a portion of said flashed vapor stream to substantial condensation and thereafter introducing said substantially condensed, flashed vapor stream to a top portion of said NGL recovery column as an overhead reflux to enhance recovery of desirable less volatile components.

17. The process of claim 16 wherein the step of cooling and introducing said gas feed into the NGL recovery column further comprises:

separating said cooled gas feed into a cooled vapor portion and a cooled liquid portion comprising condensed components, if any;

dividing said cooled vapor portion into a first vapor portion and a second vapor portion;

further cooling said vapor portion to substantial condensation and thereafter introducing said substantially condensed first vapor portion into an upper portion of said NGL recovery column as a reflux; and introducing the remaining portion of said cooled gas feed comprising said second vapor portion and said cooled liquid portion into said NGL recovery column at one or more feed stages for separation into a first gas stream primarily comprising relatively more volatile components rich in methane and a first liquid stream primarily comprising relatively less volatile components.

18. The process of claim 17 wherein said mechanical refrigeration cycle includes a refrigerant selected from the group consisting of single-component refrigerants and multi-component refrigerants.

19. The process of claim 17 wherein a refrigeration stream is withdrawn from said NGL recovery column to provide at least a portion of the refrigeration in said first cooling step.

20. The process of claim 19 wherein said refrigeration stream is partially vaporized as a result of said cooling and further comprising separating said partially vaporized refrigeration stream into a first gas phase which is re-introduced into said NGL recovery column and a first liquid phase.

21. The process of claim 17 wherein said second gas stream is cooled to partial condensation with the condensed liquid being introduced to a top portion of said NGL purifying column as an overhead reflux and the remaining vapor being introduced to a top portion of said NGL recovery column as an overhead reflux after further cooling.

22. The process of claim 21 wherein said second gas stream is cooled by a refrigeration stream withdrawn from said NGL recovery column.

23. Apparatus for recovering the relatively less volatile components from a methane-rich gas feed under pressure to produce an NGL product while rejecting the relatively more volatile components which are subsequently liquified to produce LNG, comprising:

a heat exchanger for cooling at least a portion of a gas feed by means of a mechanical refrigeration cycle;

an NGL recovery column for receiving said cooled gas feed at one or more feed stages for separation into a first gas stream primarily comprising relatively more volatile components and a first liquid stream primarily comprising relatively less volatile components;

an NGL purifying column for receiving said first liquid stream at one or more feed stages to produce an NGL product stream comprising desirable less volatile components from the bottom and a second gas stream comprising more volatile components from the overhead of said NGL purifying column;

a heat exchanger for cooling said second gas stream with mechanical refrigeration;

means for introducing said cooled, second gas stream to the top portion of said NGL recovery column as an overhead reflux to enhance recovery of desirable less volatile components; and means for liquefying said first gas stream utilizing at least one mechanical refrigeration cycle to produce a pressurized LNG stream, wherein said heat exchangers can be the same or different.

24. The apparatus of claim 23 further comprising:

a first separator for separating said cooled gas feed into a cooled vapor portion and a cooled liquid portion comprising condensed components, if any;

means for dividing said cooled vapor portion into a first vapor portion and a second vapor portion;

a heat exchanger for further cooling said first vapor portion to substantial condensation, wherein said heat exchanger can be the same or different from said other heat exchangers;

means for introducing said substantially condensed, cooled, first vapor portion into said NGL recovery column as a reflux; and means for introducing said second vapor portion and said cooled liquid portion into said NGL recovery column at one or more feed stages for separation into a first gas stream primarily comprising relatively more volatile components rich in methane and a first liquid stream primarily comprising relatively less volatile components.

25. The apparatus of claim 23 wherein said mechanical refrigeration cycle includes a refrigerant selected from the group consisting of single-component refrigerants and multi-component refrigerants.

26. The apparatus of claim 23 further comprising means for expanding said pressurized NGL stream in one or more stages to a lower pressure to produce an NGL stream suitable for storage and means for directing at least a portion of the flashed vapor generated in one or more expanding stages to said NGL recovery column as said overhead reflux.

27. Apparatus for recovering the relatively less volatile components from a methane-rich gas feed under pressure to produce an NGL product while rejecting the relatively more volatile components which are subsequently liquified to produce LNG, comprising:

a heat exchanger for cooling at least a portion of a gas feed by means of a mechanical refrigeration cycle;

an NGL recovery column for receiving said cooled gas feed at one or more feed stages for separation into a first gas stream primarily comprising relatively more volatile components and a first liquid stream primarily comprising relatively less volatile components;

an NGL purifying column for receiving said first liquid stream at one or more feed stages to produce an NGL product stream comprising desirable less volatile components from the bottom and a second gas stream comprising more volatile components from the overhead of said NGL purifying column;

a compressor for compressing said second gas stream prior to cooling to substantial condensation;

a heat exchanger for cooling said second gas stream;

means for introducing said cooled, second gas stream to the top portion of said NGL recovery column as an overhead reflux to enhance recovery of desirable less volatile components; and means for liquefying said first gas stream to produce a pressurized LNG stream, wherein said heat exchangers can be the same or different.

28. Apparatus for recovering the relatively less volatile components from a methane-rich gas feed to produce an NGL product while rejecting the relatively more volatile components which are subsequently liquified to produce LNG, comprising:

a heat exchanger for cooling at least a portion of a gas feed by means of a mechanical refrigeration cycle;

means for further cooling a portion of said cooled gas feed with mechanical refrigeration to substantial condensation;

an NGL recovery column;

means for introducing said condensed gas feed into the top of said NGL recovery column as an overhead reflux;

means for introducing the remaining portion of said cooled gas feed into said NGL recovery column at one or more feed stages for separation into a first gas stream primarily comprising relatively more volatile components rich in methane and a first liquid stream primarily comprising relatively less volatile components;

an NGL purifying column for receiving said first liquid stream at one or more feed stages to produce an NGL product stream comprising desirable less volatile components from the bottom and a second gas stream comprising more volatile components from the overhead of said NGL purifying column; and means for liquefying said first gas stream utilizing at least one mechanical refrigeration cycle to produce a pressurized LNG stream.

29. The apparatus of claim 28 further comprising:

a first separator for separating said cooled gas feed into a cooled vapor portion and a cooled liquid portion comprising condensed components, if any;

means for dividing said cooled vapor portion into a first vapor portion and a second vapor portion;

means for further cooling said first vapor portion with mechanical refrigeration to substantial condensation;

means for introducing said substantially condensed, cooled, first vapor portion into said NGL recovery column as an overhead reflux; and means for introducing said second vapor portion and said cooled liquid portion into said NGL recovery column at one or more feed stages for separation into a first gas stream primarily comprising relatively more volatile components rich in methane and a first liquid stream primarily comprising relatively less volatile components.

30. Apparatus for recovering the relatively less volatile components from a methane-rich gas feed to produce an NGL product while rejecting the relatively more volatile components which are subsequently liquified to produce LNG, comprising:

one or more heat exchangers for cooling at least a portion of a gas feed by means of mechanical refrigeration cycle;

an NGL recovery column for receiving said cooled gas feed at one or more feed stages for separation into a first gas stream primarily comprising relatively more volatile components and a first liquid stream primarily comprising relatively less volatile components;

an NGL purifying column for receiving said first liquid stream at one or more feed stages to produce an NGL product comprising desirable less volatile components from the bottom and a second gas stream comprising more volatile components from the overhead of said NGL purifying column;

means for liquifying said first gas stream to produce a pressurized LNG stream; and means for introducing at least a portion of said pressurized LNG stream to the top of said NGL recovery column as an overhead reflux to enhance recovery of relatively less volatile components.

31. The apparatus of claim 30 further comprising:

a first separator for separating said cooled gas feed into a cooled vapor portion and a cooled liquid portion comprising condensed components, if any;

means for dividing said cooled vapor portion into a first vapor portion and a second vapor portion;

means for further cooling said first vapor portion to substantial condensation;

means for introducing said substantially condensed, cooled, first vapor portion into said NGL recovery column as a middle reflux; and means for introducing said second vapor portion and said cooled liquid portion into said NGL recovery column at one or more feed stages for separation into a first gas stream primarily comprising relatively more volatile components rich in methane and a first liquid stream primarily comprising relatively less volatile components.

32. Apparatus for recovering the relatively less volatile components from a methane-rich gas feed under pressure to produce an NGL product while rejecting the relatively more volatile components which are subsequently liquified to produce LNG, comprising:

a first heat exchanger for cooling at least a portion of a gas feed by means of a mechanical refrigeration cycle;

an NGL recovery column for receiving said cooled gas feed at one or more feed stages for separation into a first gas stream primarily comprising relatively more volatile components and a first liquid stream primarily comprising relatively less volatile components;

an NGL purifying column for receiving said first liquid stream at one or more feed stages to produce an NGL product stream comprising desirable less volatile components from the bottom and a second gas stream comprising more volatile components from the overhead of said NGL purifying column;

means for liquifying said first gas stream to produce a pressurized LNG stream;

means for expanding said pressurized LNG stream in one or more stages to a lower pressure to produce an LNG stream suitable for storage and at least one flashed vapor stream;

means for compressing and cooling at least a portion of said flashed vapor stream to substantial condensation; and means for introducing said substantially condensed, flashed vapor stream to a top portion of said NGL recovery column as an overhead reflux to enhance recovery of desirable less volatile components.

33. The apparatus of claim 32 wherein said mechanical refrigeration cycle includes a refrigerant selected from the group consisting of single-component refrigerants and multi-component refrigerants.

34. A process for recovering the relatively less volatile components from a methane-rich gas feed under pressure to produce an NGL product while rejecting the relatively more volatile components which are subsequently liquified to produce LNG, comprising the steps of:

cooling at least a portion of a gas feed in one or more heat exchangers by means of a mechanical refrigeration cycle;

introducing said gas feed into an NGL recovery column at one or more feed stages for separation into a first gas stream primarily comprising relatively more volatile components and a first liquid stream primarily comprising relatively less volatile components;

introducing said first liquid stream into an NGL purifying column at one or more feed stages to produce an NGL product stream comprising desirable less volatile components from the bottom and a second gas stream comprising more volatile components from the overhead of said NGL purifying column;

cooling said second gas stream and thereafter introducing said cooled, second gas stream to the top portion of said NGL recovery column as an overhead reflux to enhance recovery of desirable less volatile components; and introducing said first gas stream directly to a next cooling step for liquefying said first gas stream to produce a pressurized LNG stream.

35. The process of claim 34 further comprising compressing said first gas stream prior to introduction to said next cooling step.

36. The process of claim 34 wherein the step of cooling and introducing said gas feed into the NGL recovery column further comprises:

separating said cooled gas feed into a cooled vapor portion and a cooled liquid portion comprising condensed components, if any;

dividing said cooled vapor portion into a first vapor portion and a second vapor portion;

further cooling said first vapor portion to substantial condensation and thereafter introducing said substantially condensed first vapor portion into an upper portion of said NGL recovery column as a reflux; and introducing the remaining portion of said cooled gas feed comprising said second vapor portion and said cooled liquid portion into said NGL recovery column at one or more feed stages for separation into a first gas stream primarily comprising relatively more volatile components rich in methane and a first liquid stream primarily comprising relatively less volatile components.

37. The process of claim 34 or 36 wherein said mechanical refrigeration cycle includes a refrigerant selected from the group consisting of single-component refrigerants and multi-component refrigerants.

38. The process of claim 34 or 36 wherein a refrigeration stream is withdrawn from said NGL recovery column to provide at least a portion of the refrigeration in said first cooling step.

39. The process of claim 38 wherein said refrigeration stream is partially vaporized as a result of said cooling and further comprising separating said partially vaporized refrigeration stream into a first gas phase which is re-introduced into said NGL recovery column and a first liquid phase.

40. The process of claim 34 or 36 wherein said second gas stream is cooled to partial condensation with the condensed liquid being introduced to a top portion of said NGL purifying column as an overhead reflux and the remaining vapor being introduced to a top portion of said NGL recovery column as an overhead reflux after further cooling.

41. The process of claim 40 wherein said second gas stream is cooled by a refrigeration stream withdrawn from said NGL recovery column.

42. Apparatus for recovering the relatively less volatile components from a methane-rich gas feed under pressure to produce an NGL product while rejecting the relatively more volatile components which are subsequently liquified to produce LNG, comprising:

a heat exchanger for cooling at least a portion of a gas feed by means of a mechanical refrigeration cycle;

an NGL recovery column for receiving said cooled gas feed at one or more feed stages for separation into a first gas stream primarily comprising relatively more volatile components and a first liquid stream primarily comprising relatively less volatile components;

an NGL purifying column for receiving said first liquid stream at one or more feed stages to produce an NGL product stream comprising desirable less volatile components from the bottom and a second gas stream comprising more volatile components from the overhead of said NGL purifying column;

a heat exchanger for cooling said second gas stream;

means for introducing said cooled, second gas stream to the top portion of said NGL recovery column as an overhead reflux to enhance recovery of desirable less volatile components; and a heat exchanger for liquefying said first gas stream to produce a pressurized LNG stream, said first gas stream being directly received by said heat exchanger without prior heating and wherein said heat exchangers can be the same or different.

43. The apparatus of claim 42 further comprising a compressor for compressing said first gas stream prior to liquefaction in said heat exchanger.

44. The apparatus of claim 42 further comprising:

a first separator for separating said cooled gas feed into a cooled vapor portion and a cooled liquid portion comprising condensed components, if any;

means for dividing said cooled vapor portion into a first vapor portion and a second vapor portion;

a heat exchanger for further cooling said first vapor portion to substantial condensation wherein said heat exchanger can be the same or different from said other heat exchangers;

means for introducing said substantially condensed, cooled, first vapor portion into said NGL recovery column as a reflux; and means for introducing said second vapor portion and said cooled liquid portion into said NGL recovery column at one or more feed stages for separation into a first gas stream primarily comprising relatively more volatile components rich in methane and a first liquid stream primarily comprising relatively less volatile components.

45. The apparatus of claim 42 wherein said mechanical refrigeration cycle includes a refrigerant selected from the group consisting of single-component refrigerants and multi-component refrigerants.

46. The apparatus of claim 42 further comprising means for expanding said pressurized NGL stream in one or more stages to a lower pressure to produce an NGL stream suitable for storage and means for directing at least a portion of the flashed vapor generated in one or more expanding stages to said NGL recovery column as said overhead reflux.

47. The apparatus of claim 42 further comprising a compressor for compressing said second gas stream prior to cooling to substantial condensation.

* * * * *

UNITED STATES PATENT AND TRADEMARK OFFICE

CERTIFICATE OF CORRECTION

PATENT NO. : 6,401,486 B1 
DATED : June 11, 2002
INVENTOR(S) : Lee, Rong-Jwyn et al.

It is certified that error appears in the above-identified patent and that said Letters Patent is hereby corrected as shown below:

Column 23,
Line 37, replace "17" with -- 16 --.
Line 41, replace "17" with -- 16 --.
Line 49, replace "17" with -- 16 --.

Signed and Sealed this

Eighteenth Day of February, 2003

JAMES E. ROGAN
*Director of the United States Patent and Trademark Office*